US008439692B1

(12) United States Patent
Oddsen et al.

(10) Patent No.: US 8,439,692 B1
(45) Date of Patent: May 14, 2013

(54) BUS BAR ARRANGEMENTS FOR MULTIPLE OUTLET ELECTRICAL RECEPTACLES

(75) Inventors: Dennis A. Oddsen, Northport, NY (US); Jian H. Li, Bayside, NY (US)

(73) Assignee: Hubbell Incorporated, Shelton, CT (US)

( * ) Notice: Subject to any disclaimer, the term of this patent is extended or adjusted under 35 U.S.C. 154(b) by 27 days.

(21) Appl. No.: 13/286,413

(22) Filed: Nov. 1, 2011

(51) Int. Cl.
*H01R 4/66* (2006.01)

(52) U.S. Cl.
USPC ..... 439/107

(58) Field of Classification Search ..... 439/535, 439/536, 538, 654, 650, 652, 107; 174/54, 174/76, 77
See application file for complete search history.

(56) References Cited

U.S. PATENT DOCUMENTS

| | | | | |
|---|---|---|---|---|
| 1,752,225 | A * | 3/1930 | Birchall | 439/539 |
| 1,831,809 | A | 11/1931 | Hertzberg | |
| 3,017,601 | A | 1/1962 | Benander | |
| 3,246,179 | A | 4/1966 | Berner | |
| 3,327,277 | A | 6/1967 | Ramsing | |
| 3,358,261 | A | 12/1967 | Gaines et al. | |
| 4,240,686 | A | 12/1980 | Kurbikoff | |
| 4,545,631 | A | 10/1985 | Zampini | |
| 4,583,799 | A * | 4/1986 | Wiley | 439/106 |
| D284,758 | S | 7/1986 | Maloney | |
| 4,688,135 | A | 8/1987 | Leopold | |
| 4,978,318 | A * | 12/1990 | Wiley et al. | 439/536 |
| 5,046,963 | A | 9/1991 | Kelly | |
| 5,098,307 | A | 3/1992 | Francisco | |
| 5,124,876 | A | 6/1992 | Misencik et al. | |
| 5,135,411 | A | 8/1992 | Wiley | |
| 5,241,143 | A | 8/1993 | Adams | |
| 5,281,154 | A | 1/1994 | Comerci et al. | |
| 5,322,449 | A * | 6/1994 | Pizano | 439/222 |
| 5,368,490 | A | 11/1994 | McKissick | |
| 5,541,457 | A | 7/1996 | Morrow | |
| 5,598,042 | A | 1/1997 | Mix et al. | |
| 5,601,455 | A * | 2/1997 | Bagga | 439/650 |
| 5,763,826 | A | 6/1998 | Castellani et al. | |
| D402,186 | S * | 12/1998 | Pearse | D8/353 |
| 6,196,851 | B1 | 3/2001 | Gerard et al. | |
| 6,315,617 | B1 * | 11/2001 | Al-Sabah | 439/652 |
| 6,353,180 | B1 * | 3/2002 | DeBartolo et al. | 174/483 |
| 6,483,028 | B2 * | 11/2002 | DeBartolo et al. | 174/483 |

(Continued)

FOREIGN PATENT DOCUMENTS

| | | |
|---|---|---|
| JP | 3055776 | 3/1991 |
| JP | 6245346 | 9/1994 |

*Primary Examiner* — Alexander Gilman
(74) *Attorney, Agent, or Firm* — Alan I. Cantor; Mark S. Bicks; Alfred N. Goodman

(57) ABSTRACT

A triplex electrical receptacle has a flexible, compact arrangement of bus bars and phase, neutral and ground contacts associated with three outlets. Two outlets are nearest two corners of the body that share a common first side, and the third outlet is between them but closer to the opposite side of the body. A common neutral bus bar (with terminal) is connected to the neutral contacts of all three outlets. The phase bus bar (with terminal) is connected to the phase contacts of at least two of the outlets. One embodiment permanently connects the phase contact of the third outlet to the phase bus bar; another embodiment permanently isolates the third outlet, connecting its phase contact to a separate phase terminal; and an additional embodiment incorporates a separate phase terminal for the third outlet and an optionally severable connection between the third outlet and the first phase terminal.

20 Claims, 40 Drawing Sheets

U.S. PATENT DOCUMENTS

| | | | | |
|---|---|---|---|---|
| D467,875 | S | 12/2002 | Barger et al. | |
| D505,856 | S * | 6/2005 | Kim et al. | D8/353 |
| 6,902,429 | B1 * | 6/2005 | Brooks | 439/535 |
| 6,923,663 | B2 * | 8/2005 | Oddsen et al. | 439/107 |
| 7,071,414 | B2 * | 7/2006 | Kim | 174/66 |
| 7,121,834 | B2 | 10/2006 | Gerard | |
| 7,125,256 | B2 | 10/2006 | Gerard | |
| D532,375 | S * | 11/2006 | Kim et al. | D13/139.2 |
| 7,193,830 | B2 * | 3/2007 | Fournier et al. | 361/111 |
| 7,204,696 | B1 | 4/2007 | Libby, II et al. | |
| 7,238,028 | B2 | 7/2007 | Gerard | |
| 7,255,596 | B2 * | 8/2007 | Pyrros | 439/535 |
| 7,278,878 | B2 | 10/2007 | Draggie et al. | |
| 7,347,724 | B2 | 3/2008 | Crupi | |
| 7,410,379 | B1 | 8/2008 | Byrne | |
| 7,504,745 | B2 | 3/2009 | Lee | |
| 7,547,221 | B2 | 6/2009 | Kim et al. | |
| 7,749,019 | B2 | 7/2010 | Valentine et al. | |
| 7,789,686 | B2 * | 9/2010 | Kim | 439/218 |
| 7,800,252 | B2 | 9/2010 | DuBose et al. | |
| 7,824,196 | B1 * | 11/2010 | Oddsen et al. | 439/106 |
| 7,964,995 | B2 | 6/2011 | Dubose et al. | |
| 8,011,937 | B2 * | 9/2011 | Oddsen et al. | 439/107 |
| 2003/0024724 | A1 | 2/2003 | Leifer | |
| 2005/0211460 | A1 | 9/2005 | Draggie et al. | |
| 2005/0239336 | A1 * | 10/2005 | Crupi | 439/654 |
| 2005/0263313 | A1 | 12/2005 | Oddsen et al. | |
| 2007/0149061 | A1 * | 6/2007 | Oddsen et al. | 439/651 |
| 2011/0076884 | A1 | 3/2011 | Pyrros | |

* cited by examiner

BUS BAR ARRANGEMENTS FOR MULTIPLE OUTLET ELECTRICAL RECEPTACLES

FIELD OF THE INVENTION

The invention relates to electrical receptacles, in particular, to multiple outlet electrical receptacles that are mountable in standard electrical wall boxes.

BACKGROUND OF THE INVENTION

Contemporary electrical receptacles designed to fit in a NEMA-standard single electrical wall box typically have two polarized grounded outlets, with the face openings of the outlets oriented in the same direction. Such an arrangement provides ample clearance for two straight plugs and for some, but not all, types of right angle plugs, chargers and transformers. Some duplex receptacles are designed to accommodate two larger transformers or chargers and most right angle plugs by orienting the face openings of the outlets in different directions. See, e.g., U.S. Pat. No. 7,278,878 to Draggie, et al.

The need to power three or more devices from a duplex receptacle usually requires the use of unwieldy cube taps or power strips. Efforts have been made to fit three or more grounded outlets, oriented in different directions, into a receptacle body that can fit into a NEMA-standard single wall box. See, e.g., U.S. Pat. No. 6,923,663 to Oddsen, et al., and U.S. Pat. No. 7,347,724 to Crupi. However, such solutions require non-standard constructions. For example, the ANSI/NEMA WD 6 (R2008) dimensional standard for popular "decorator" style wiring devices ("Dimensions for Flush Mount Rectangular Face Devices") specifies maximum face dimensions for a duplex receptacle of 1.300 in. wide by 2.620 in. long, and a mating wall plate opening at least 0.010 in. larger in each dimension. The receptacles of Oddsen, and those of Crupi having more than two outlets, do not comply with this standard because they have oversize rectangular faces and require oversize matching wall plates. Crupi's marginal ground prong openings (and the ground prongs received therein) undesirably are disposed outside the perimeter of the wall box. Oddsen's triplex receptacle (FIG. 1), with all ground prong openings centrally clustered, is prone to blockage of open slots when certain chargers, transformers or right angle plugs are used. The same problems are inherent in Oddsen's "sixplex" receptacle (FIG. 16), which is sized to fit into a standard double or ganged wall box.

A need therefore exists for a standard-size electrical receptacle for mounting in a standard single wall box, especially a decorator-style receptacle, having three outlets that can accommodate plugs, chargers and transformers of many sizes and types at once, with all ground prongs kept within the wall box. Similarly, a need exists for a standard-size electrical receptacle for mounting in a standard-size double wall box, especially a decorator-style receptacle, having six outlets that can also accommodate plugs, chargers and transformers of many sizes and types at once, with all ground prongs kept within the wall box.

SUMMARY OF THE INVENTION

The above needs are met by receptacle embodiments disclosed in commonly owned U.S. Pat. No. 7,824,196. The invention claimed herein concerns the bus bar and terminal arrangements disclosed in U.S. Pat. No. 7,824,196, as well as variants thereof that enable connection of at least one of the outlets to a separate circuit.

In a generic sense, the invention is directed to a triplex electrical receptacle comprising a substantially rectangular body of a standard size. There are phase, neutral and ground contacts within the body associated with respective first, second and third outlets and accessible via respective phase blade openings, neutral blade openings and ground prong openings in the face of the body. The contacts of the first outlet are nearest a first corner of the body bounded by the body's first side and first end; the contacts of the second outlet are nearest a second corner of the body bounded by the body's first side and second end; and the contacts of the third outlet are between the contacts of the first and second outlets and closer to the second side of the body than to its first side. A neutral bus bar within the body is connected to the neutral contacts of all three of the outlets. The neutral bus bar has a central portion extending along the second side of the body, and two arms. The central portion has a neutral terminal and supports the neutral contact of the third outlet. The first arm extends obliquely from the central portion toward the first corner and supports the neutral contact of the first outlet. The second arm extends transversely from the central portion toward the second corner and supports the neutral contact of the second outlet. At least one phase bus bar within the body is connected to the phase contacts of at least two of the outlets. The phase bus bar has a phase terminal at the second side of the body, and two arms. The first arm extends obliquely from the second side toward the first outlet and supports the phase contact of the first outlet. The second arm extends behind the first arm of the neutral bus bar longitudinally toward the third outlet, where it supports the phase contact of that outlet.

In some embodiments the phase bus bar has a third arm that extends across the body toward the second outlet, where it supports and is electrically connected to the phase contact of that outlet. In one of those embodiments the third arm is connected to a second phase terminal at the first side of the body, and there is a frangible connection along the third arm that can be ruptured to electrically isolate the second phase terminal and the second outlet from the other two outlets. In another embodiment the second outlet is isolated by connection only to a second phase bus bar on the first side of the body that has its own phase terminal.

BRIEF DESCRIPTION OF THE DRAWINGS

Preferred embodiments of the disclosed invention, including the best mode for carrying out the invention, are described in detail below, purely by way of example, with reference to the accompanying drawing figures.

FIG. 1 is a front view of a first embodiment of electrical receptacle according to the invention, installed behind a wall plate;

FIG. 2 is a front view similar to FIG. 1, showing a three-wire grounded plug installed in each outlet;

FIG. 3 is a rear schematic view of the arrangement shown in FIG. 2;

FIG. 4 is a front view similar to FIG. 2, showing two three-wire grounded plugs and one transformer installed in respective outlets;

FIG. 5 is a perspective view of the receptacle of FIG. 1 without the wall plate, showing the face, one side and one end thereof;

FIG. 6 is a perspective view of the receptacle of FIG. 5, showing the face, the opposite side and the opposite end thereof;

FIG. 7 is a bottom perspective view of the receptacle of FIG. 5;

FIG. 8 is a front elevational view of the receptacle of FIG. 5;

FIG. 9 is a right-side view of the receptacle of FIG. 5;

FIG. 10 is a rear elevational view of the receptacle of FIG. 5;

FIG. 11 is a left-side view of the receptacle of FIG. 5;

FIG. 12 is an exploded view of the receptacle of FIG. 5;

FIG. 13 is a perspective view of the receptacle of FIG. 5 with the base and the front cover removed to show the ground strap, the bus bars, the contacts and the contact separator;

FIG. 14 is a top plan view of the phase and neutral bus bars and contacts per se shown in their proper spatial arrangement;

FIG. 15 is a front elevational view of the phase and neutral bus bar and contact arrangement of FIG. 14;

FIG. 16 is a bottom plan view of the phase and neutral bus bar and contact arrangement of FIG. 14;

FIG. 17 is a top plan view of the ground strap, bus bar, contact and separator arrangement shown in FIG. 13;

FIG. 18 is a bottom plan view of the ground strap, bus bar, contact and separator arrangement shown in FIG. 13;

FIG. 19 is a bottom plan view of the front cover of the receptacle of FIG. 5, showing three tamper-resistant mechanisms installed therein, one for each outlet;

FIG. 20 is an exploded view of one of the tamper-resistant mechanisms shown in FIG. 19;

FIG. 21 is a perspective view of one of the tamper-resistant mechanisms shown in FIG. 19;

FIG. 22 is a top plan view of the tamper-resistant mechanism shown in FIG. 21;

FIG. 23 is a cross-sectional view of the tamper-resistant mechanism taken along line 23-23 in FIG. 22;

FIG. 24 is a schematic front view of the outlet face opening arrangement of the preferred embodiment of FIG. 1;

FIG. 25 is a schematic front view of an outlet face opening arrangement according to a second embodiment;

FIG. 26 is a schematic front view of an outlet face opening arrangement according to a third embodiment;

FIG. 27 is a schematic front view of an outlet face opening arrangement according to a fourth embodiment;

FIG. 28 is a schematic front view of an outlet face opening arrangement according to a fifth embodiment;

FIG. 29 is a schematic front view of an outlet face opening arrangement according to a sixth embodiment;

FIG. 30 is a schematic front view of an outlet face opening arrangement according to a seventh embodiment;

FIG. 31 is a schematic front view of an outlet face opening arrangement according to an eighth embodiment;

FIG. 33 is a front view of a tenth embodiment of electrical receptacle according to the invention (installed behind a wall plate) adapted for connection of at least one outlet thereof to a separate circuit;

FIG. 34 is a perspective view of the receptacle of FIG. 33 without the wall plate, showing the face, one side and one end thereof;

FIG. 35 is a perspective view of the receptacle of FIG. 34, showing the face, the opposite side and the opposite end thereof;

FIG. 36 is a bottom perspective view of the receptacle of FIG. 34;

FIG. 37 is a front elevational view of the receptacle of FIG. 34;

FIG. 38 is a right-side view of the receptacle of FIG. 34;

FIG. 39 is a rear elevational view of the receptacle of FIG. 34;

FIG. 40 is a left-side view of the receptacle of FIG. 34;

FIG. 41 is an exploded view of the receptacle of FIG. 34;

FIG. 42 is a perspective view of the receptacle of FIG. 34 with the base and the front cover removed to show the ground strap, the bus bars, the contacts and the contact separator;

FIG. 43 is a top plan view of the phase and neutral bus bars and contacts per se shown in their proper spatial arrangement;

FIG. 44 is a front elevational view of the phase and neutral bus bar and contact arrangement of FIG. 43;

FIG. 45 is a bottom plan view of the phase and neutral bus bar and contact arrangement of FIG. 43;

FIG. 46 is a top plan view of the ground strap, bus bar, contact and separator arrangement shown in FIG. 42;

FIG. 47 is a bottom plan view of the ground strap, bus bar, contact and separator arrangement shown in FIG. 42;

FIG. 48 is a perspective view of an eleventh embodiment of electrical receptacle according to the invention adapted for connection of at least one outlet thereof to a separate circuit, showing the face, one side and one end thereof;

FIG. 49 is a perspective view of the receptacle of FIG. 48, showing the face, the opposite side and the opposite end thereof;

FIG. 50 is a bottom perspective view of the receptacle of FIG. 48;

FIG. 51 is a front elevational view of the receptacle of FIG. 48;

FIG. 52 is a right-side view of the receptacle of FIG. 48;

FIG. 53 is a rear elevational view of the receptacle of FIG. 48;

FIG. 54 is a left-side view of the receptacle of FIG. 48;

FIG. 55 is an exploded view of the receptacle of FIG. 48;

FIG. 56 is a perspective view of the receptacle of FIG. 48 with the base and the front cover removed to show the ground strap, the bus bars, the contacts and the contact separator;

FIG. 57 is a top plan view of the phase and neutral bus bars and contacts per se shown in their proper spatial arrangement;

FIG. 58 is a front elevational view of the phase and neutral bus bar and contact arrangement of FIG. 57;

FIG. 59 is a bottom plan view of the phase and neutral bus bar and contact arrangement of FIG. 57;

FIG. 60 is a top plan view of the ground strap, bus bar, contact and separator arrangement shown in FIG. 56; and FIG. 61 is a bottom plan view of the ground strap, bus bar, contact and separator arrangement shown in FIG. 56.

DETAILED DESCRIPTION OF THE INVENTION

As used in this application, terms such as "front," "rear," "side," "top," "bottom," "above," "below," "upwardly" and "downwardly" are intended to facilitate the description of the electrical receptacle of the invention, and are not intended to limit the structure of the invention to any particular position or orientation.

Figure 1:
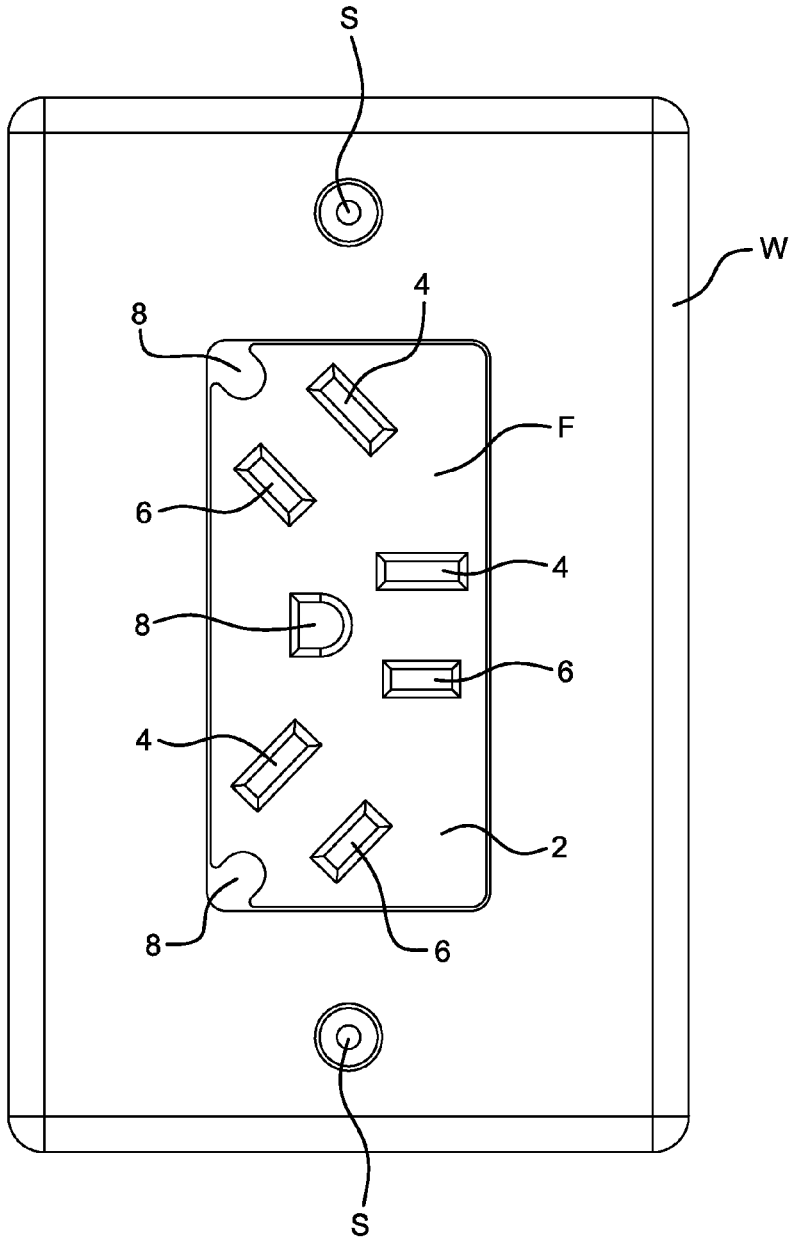
FIGS. 1-31 and the description thereof are substantially reproduced herein from commonly owned U.S. Pat. No. 7,824,196.
Figure 24:
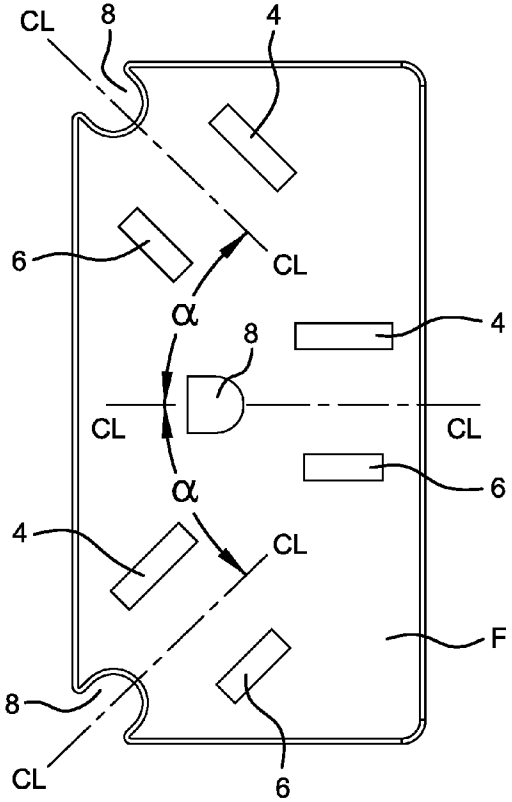

Referring to FIGS. 1 and 24, an electrical receptacle according to a preferred first embodiment of the invention has a body sized to fit in a NEMA-standard single wall box. The body has a front cover 2 with rectangular face F, which is exposed through a slightly larger rectangular opening in a wall plate W having mounting screw holes S. The dimensions of face F comply with the ANSI/NEMA WD 6 (R2008) dimensional standard for popular "decorator" style wiring devices ("Dimensions for Flush Mount Rectangular Face Devices"), which specifies maximum face dimensions for a duplex receptacle of 1.300 in. wide by 2.620 in. long, and a mating wall plate opening at least 0.010 in. larger in each dimension. In this and all other embodiments specifically disclosed herein, the duplex-sized face of the receptacle preferably is 1.290 in. wide by 2.604 in. long. The face F has three outlets associated with respective phase, neutral and ground contacts (not shown), which are accessible through respective phase blade openings 6, neutral blade openings 4 and ground prong openings 8 in the face.

The size and spacing of the openings for each outlet also comply with ANSI/NEMA WD 6 (R2008); thus, the neutral blade openings 4 are illustrated as longer that the phase blade openings 6. Phase blade openings 6 are illustrated as simple straight slots, which is the standard configuration for 15 ampere receptacles. If the receptacle is intended for use in a 20 ampere circuit with 15 ampere and/or 20 ampere plugs, one or more of the outlets would have a NEMA-standard T-shaped phase blade opening.

Each outlet has a centerline CL (see FIG. 24) that passes through its ground prong opening 8 and is parallel to its phase and neutral blade openings 6, 4. The two outer outlets are positioned with their laterally open ground prong openings 8 at the corners of the face F, and with their centerlines oblique to the edges of the face, preferably at an angle of about 45°. The centerline of the central outlet is parallel to the shorter edges of the face, and bisects the face. Thus, the centerlines of the outlets are mutually nonparallel; and those of the corner outlets are disposed at an angle $\alpha$ of about 45° to the centerline of the center outlet.

Figure 2:
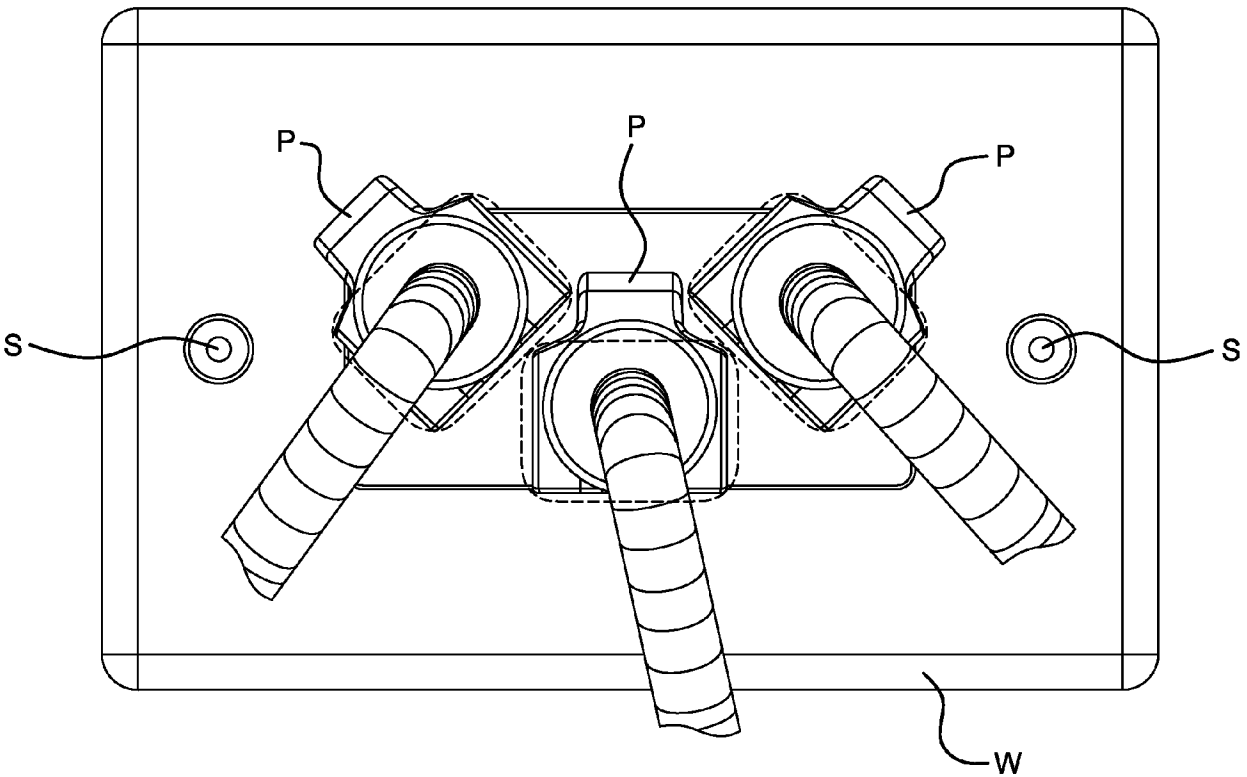
Figure 3:
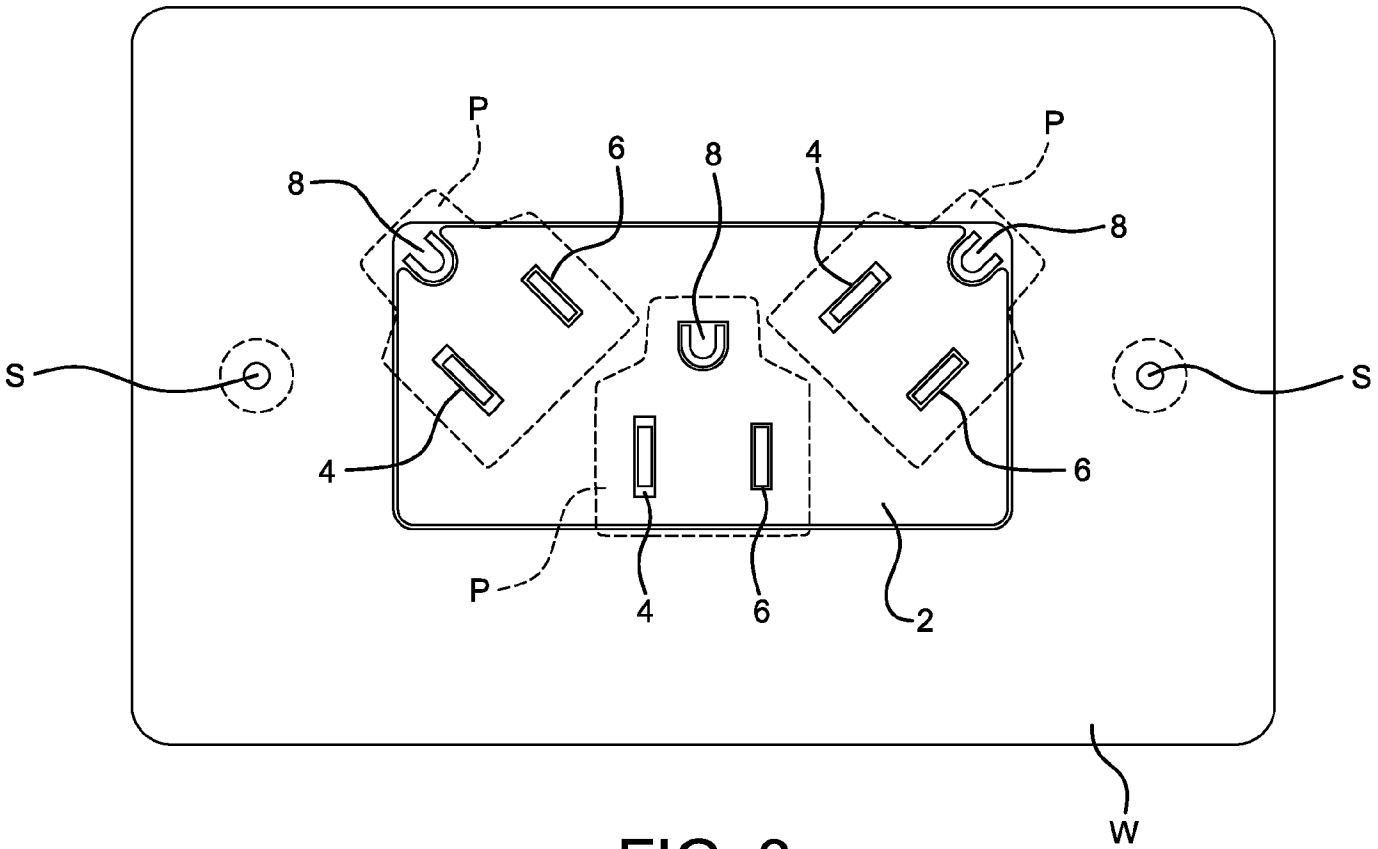
Figure 4:
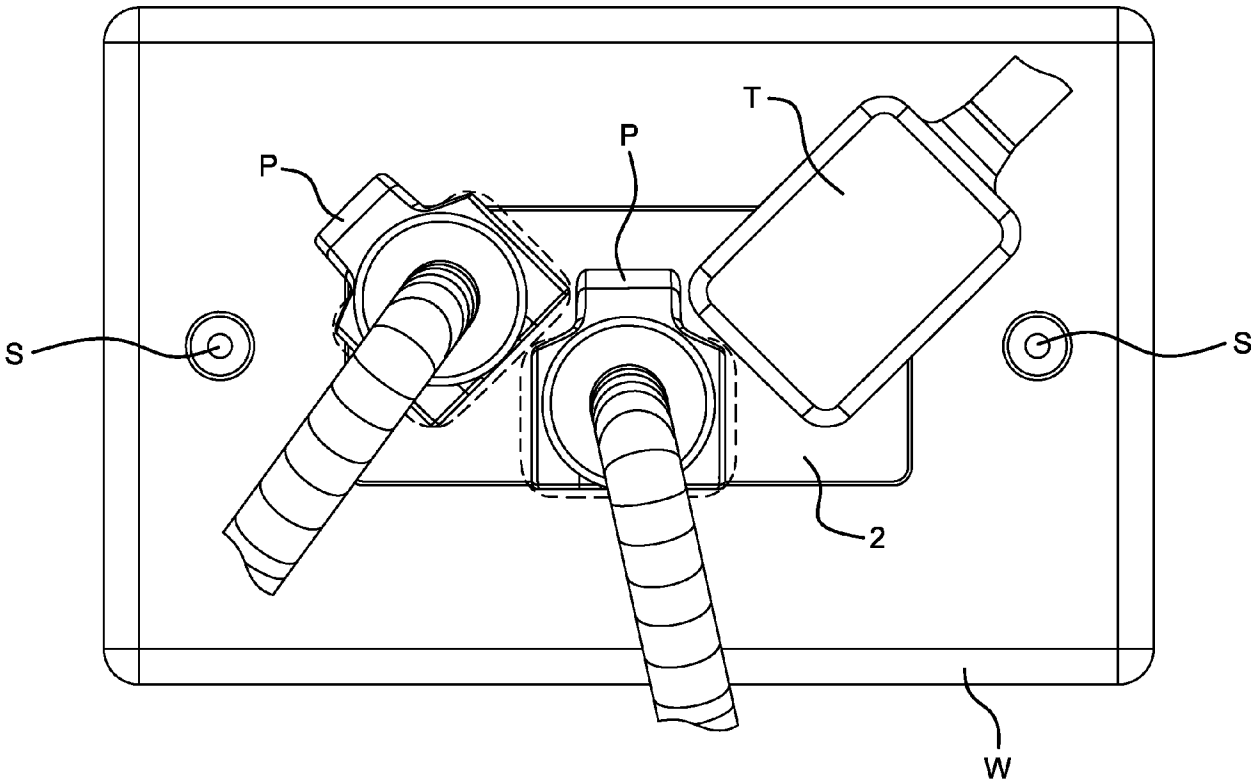
Figure 5:
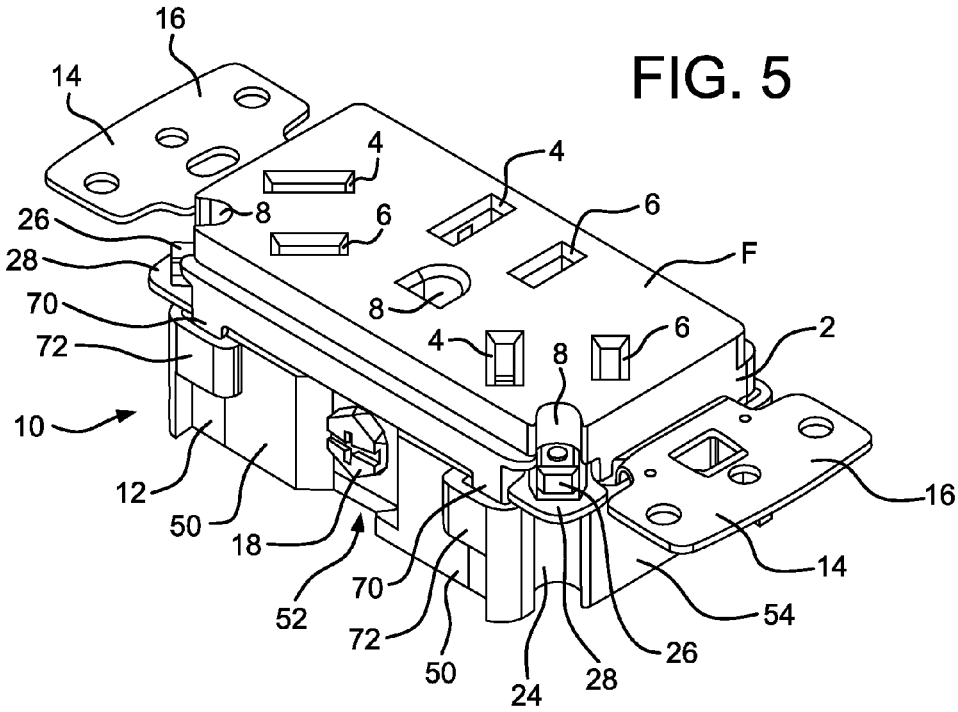
Figure 6:
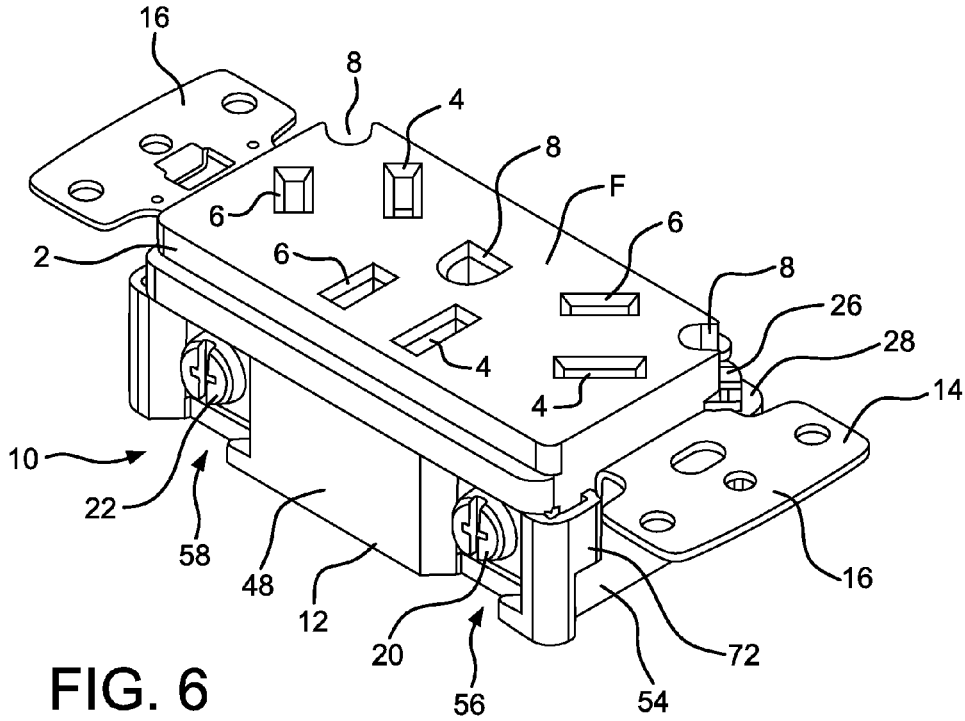
Figure 7:
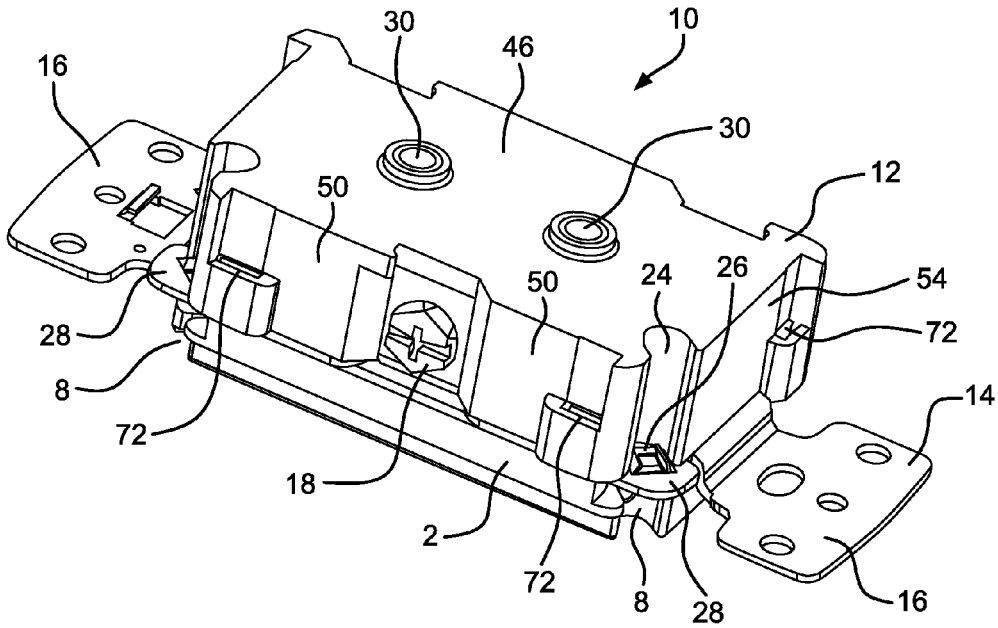
Figure 8:
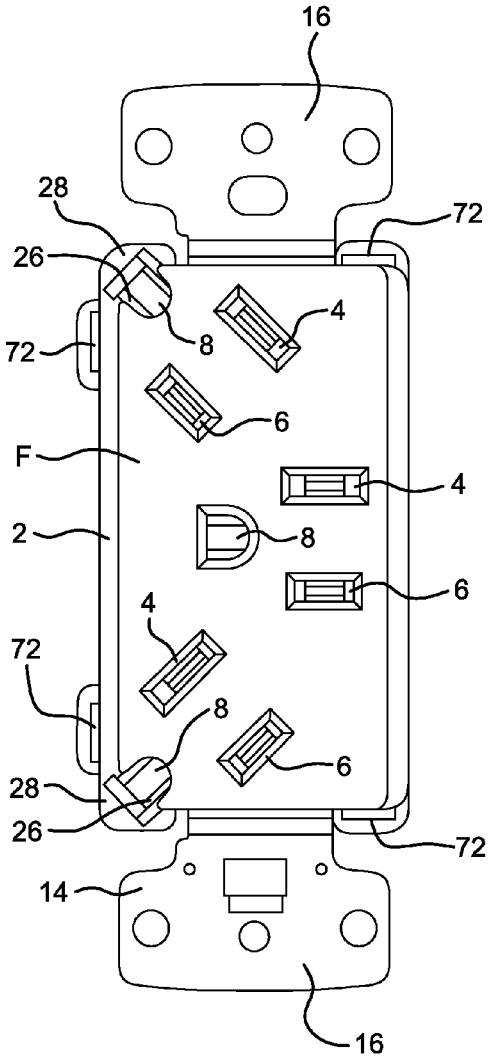
Figure 9:
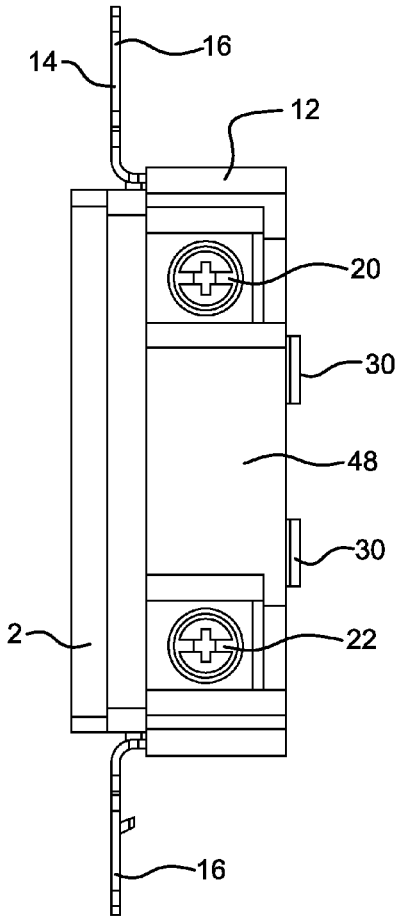
Figure 10:
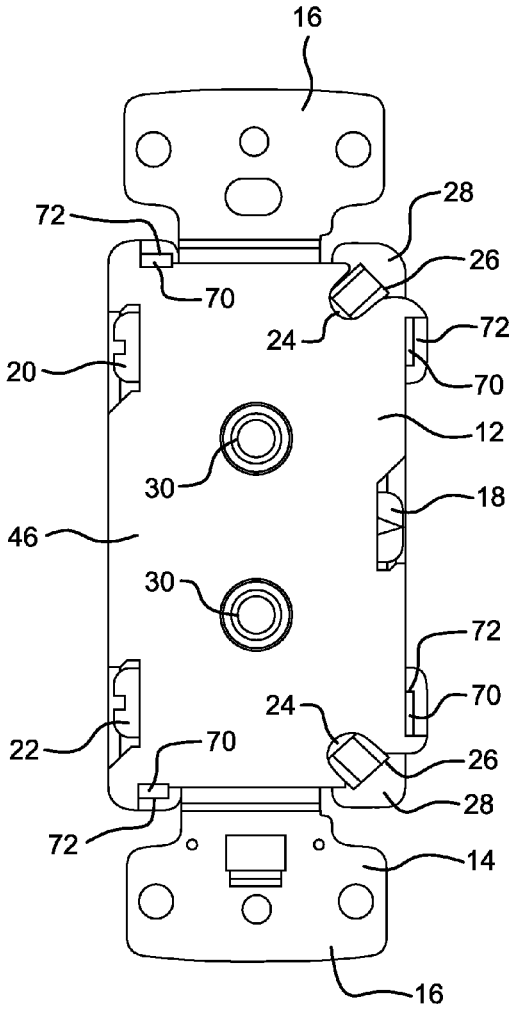
Figure 11:
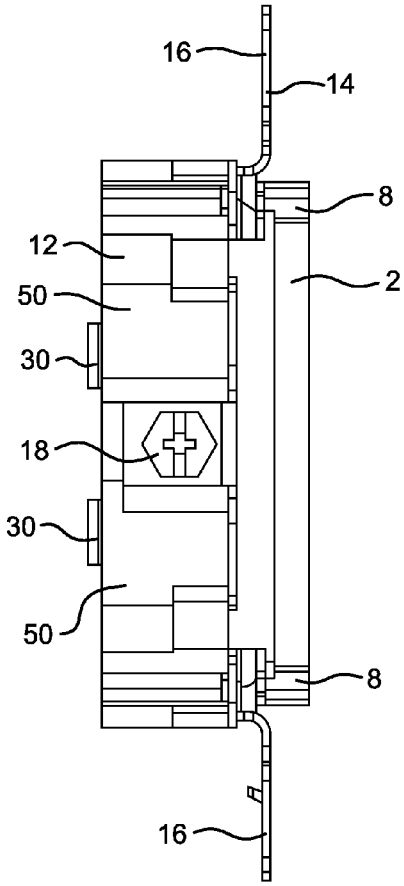
Figure 12:
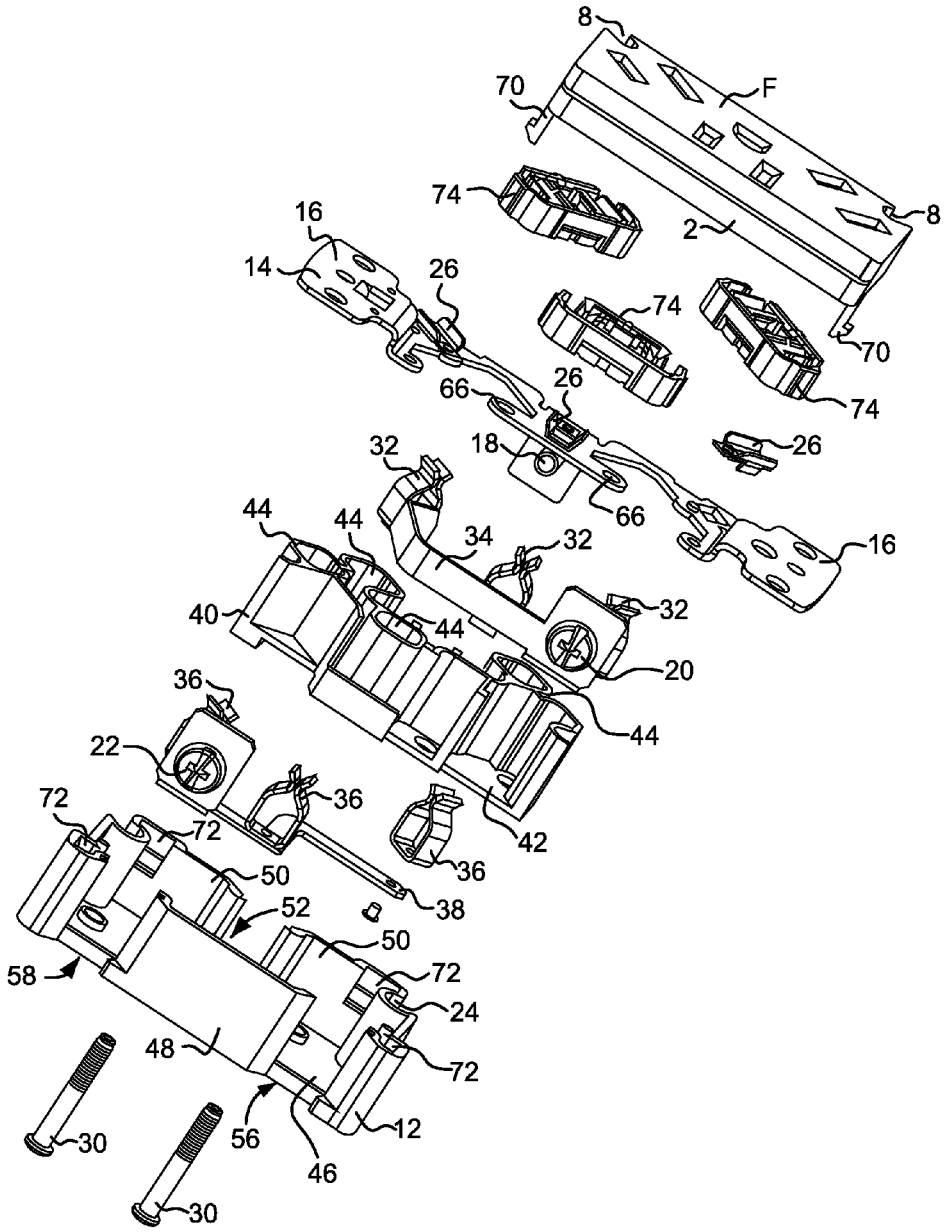
Figure 13:
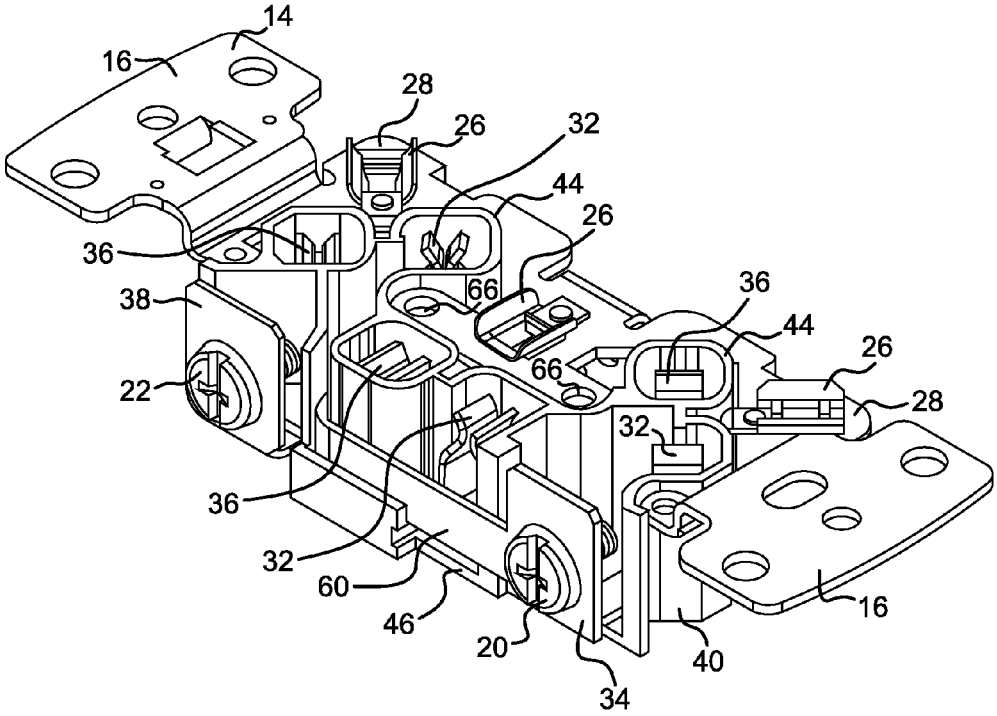
Figure 14:
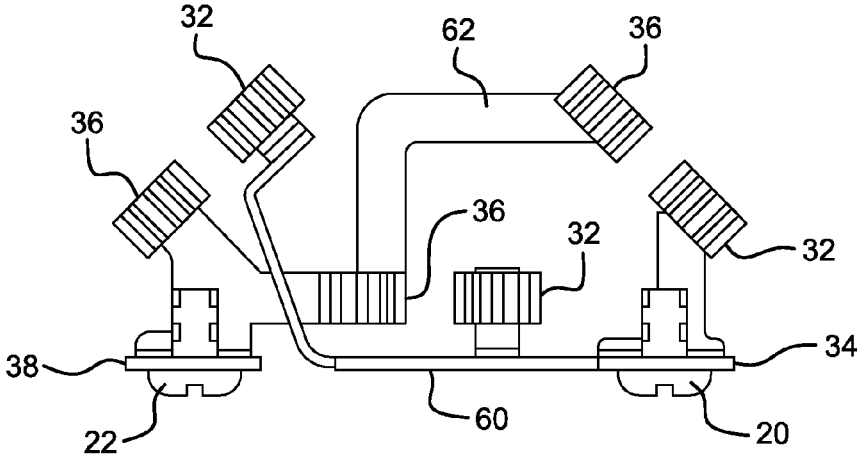
Figure 15:
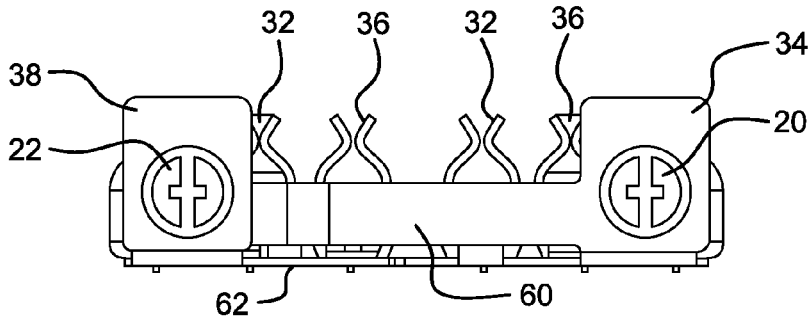
Figure 16:
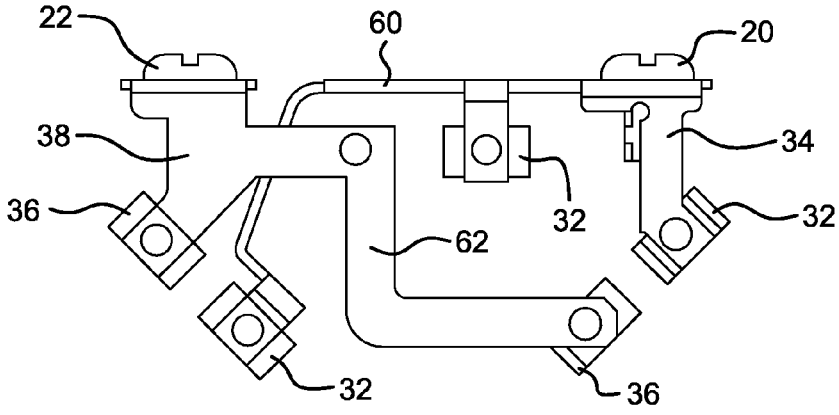
Figure 17:
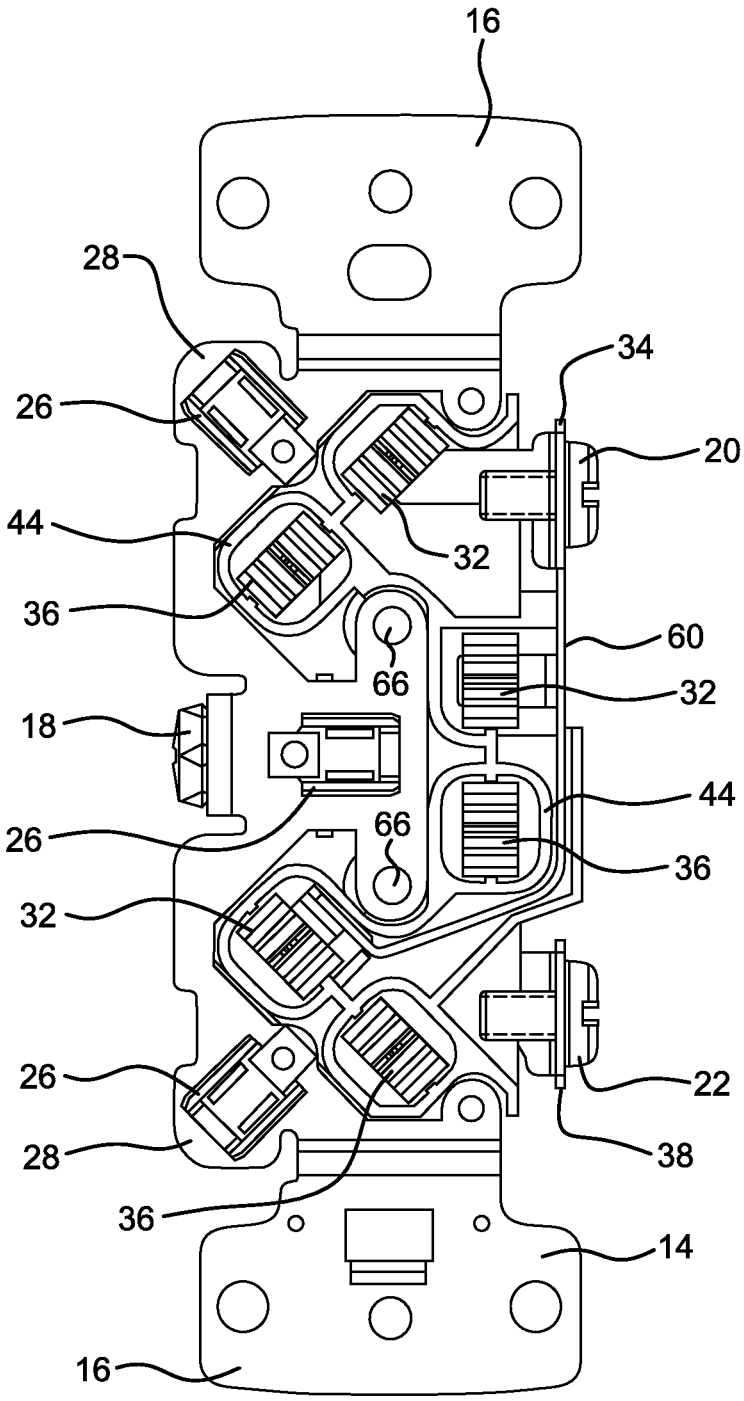
Figure 18:
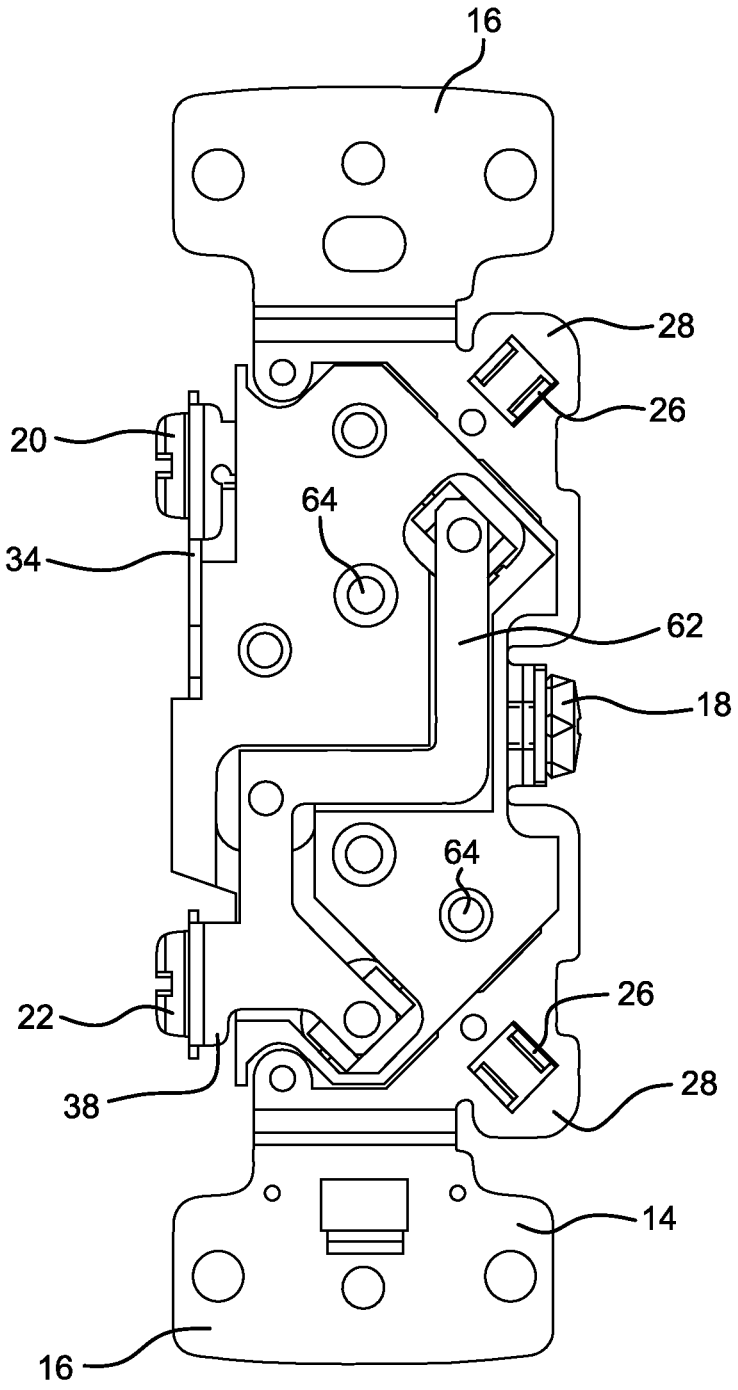

FIGS. 2 and 3 illustrate how the receptacle of FIG. 1 can simultaneously accommodate three plugs, all of the grounded (three-wire) type P, or all of the two-wire type, or any combination of those types. The dashed lines in FIG. 2 show the nominal outline of the face of a two-wire general-use plug as specified by ANSI/UL 817-2007, §25.2.1 (1.000 in. by 0.750 in., maximum corner radius of 7/32 in.). FIG. 3 shows the blades and the ground prongs of the plugs received in the face openings 4, 6, 8. FIG. 4 illustrates how the receptacle of FIG. 1 can simultaneously accommodate at least one transformer T in combination with three-wire plugs P and/or two-wire plugs (dashed lines). It will be appreciated that two such transformers, one in each corner outlet (not shown), can be accommodated along with a plug in the center outlet.

FIGS. 5-11 depict the external features of the receptacle of FIGS. 1 and 24. Receptacle body 10 has an insulating plastic base 12 and an insulating plastic front cover 2 attached to a conducting metallic ground strap 14 sandwiched between the base and the front cover. Flanges 16 of ground strap 14 have standard mounting holes for attaching the receptacle to a wall box with screws, and standard threaded holes for attaching a wall plate W with screws through screw holes S. Screw terminals, which provide connections to line conductors, consist of a ground terminal 18 on the left side of the base 12, and a phase terminal 22 and a neutral terminal 202 on the right side. The face F of front cover 2 has openings 4, 6, 8 as described above. The laterally open ground prong openings 8 at the corners of the face are aligned with corner grooves 24 in the base 12 so as to accommodate the ground prongs of plugs that penetrate corner openings 8 and ground contacts 26, which are carried by two protruding corners 28 of ground strap 14. Assembly screws 30, along with other fastening elements (described below), secure base 12, ground strap 14 and front cover 2 together.

Referring to FIGS. 12-18, three phase contacts 36 are riveted or otherwise secured to a phase bus bar 38, and three neutral contacts 32 are riveted or otherwise secured to a neutral bus bar 34. Bus bars 34, 38 are flat brass stampings. An insulating plastic contact separator 40 fits within base 12 and has a bottom wall 42 and upstanding dividers 44 that insulate the phase and neutral bus bars and contacts from one another. Base 12 has a bottom wall 46; a central upstanding side wall 48 at the phase terminal and neutral terminal side of the receptacle; two upstanding side walls 50 at the opposite side of the receptacle defining a gap 52 therebetween (in which ground terminal 18 resides); and upstanding end walls 54 joined to walls 50 and defining therewith corner grooves 24. Side wall 48 and end walls 54 define two gaps 56, 58. Neutral bus bar 34 is disposed above the bottom wall 42 of contact separator 40. The upstanding side portion 60 of neutral bus bar 34 runs behind side wall 48, with neutral terminal 20 exposed in gap 56. Phase terminal 22 is exposed in gap 58. The flat S-shaped portion 62 of phase bus bar 38 lies between the bottom wall 42 of contact separator 40 and the bottom wall 46 of base 12.

Assembly screws 30 pass through holes (not shown) in bottom wall 46 of base 12, holes 64 in bottom wall 42 of contact separator 40, and holes 66 in ground strap 14. Screws 30 engage bosses 68 on the underside of front cover 2 (see FIG. 19) to secure the parts together. Four snap fasteners also hold the parts together. These consist of four shouldered tabs 70 on front cover 2 that fit into and lock against mating structures (not shown) within slots 72 on base 12.

Figure 19:
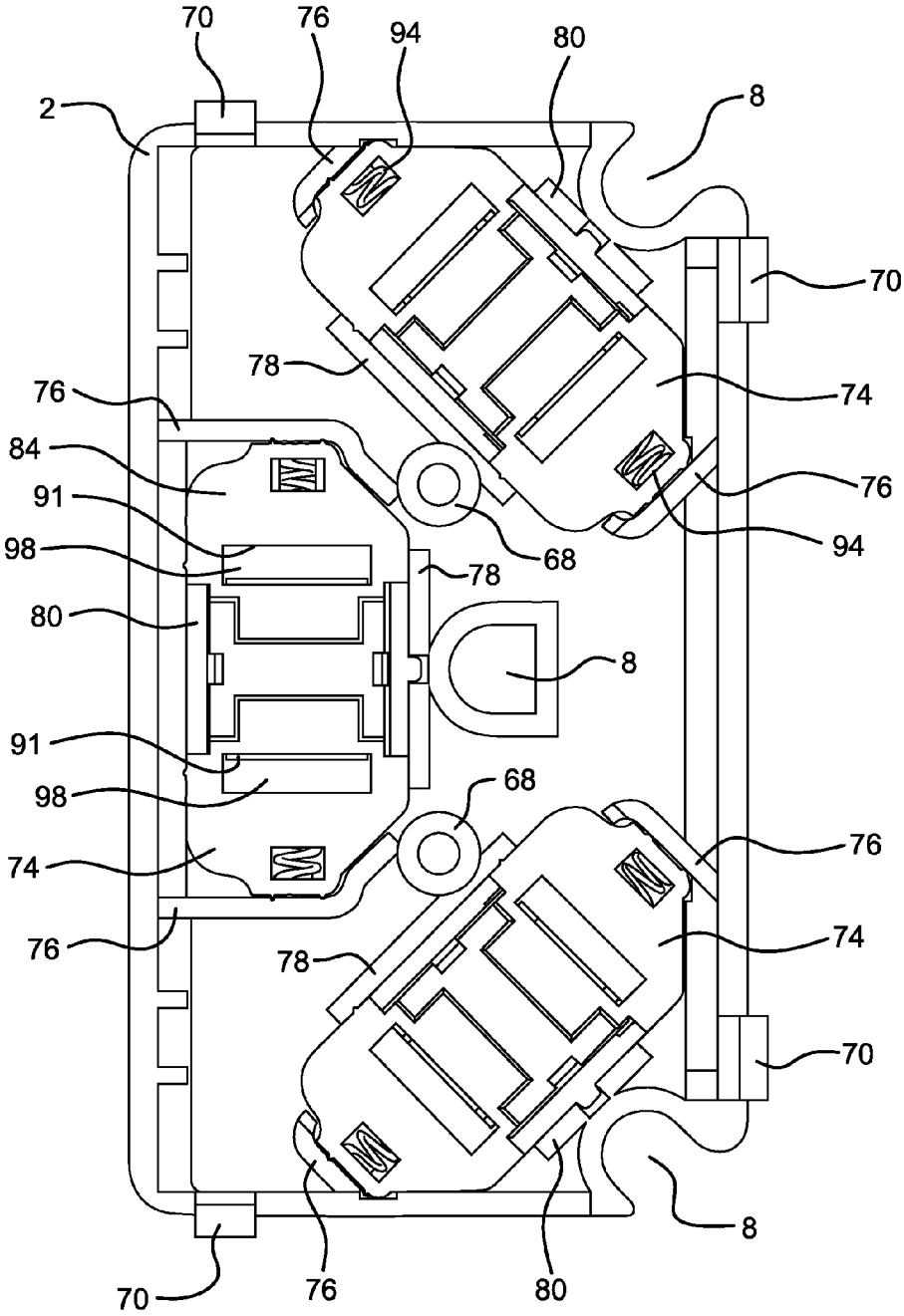
Figure 20:
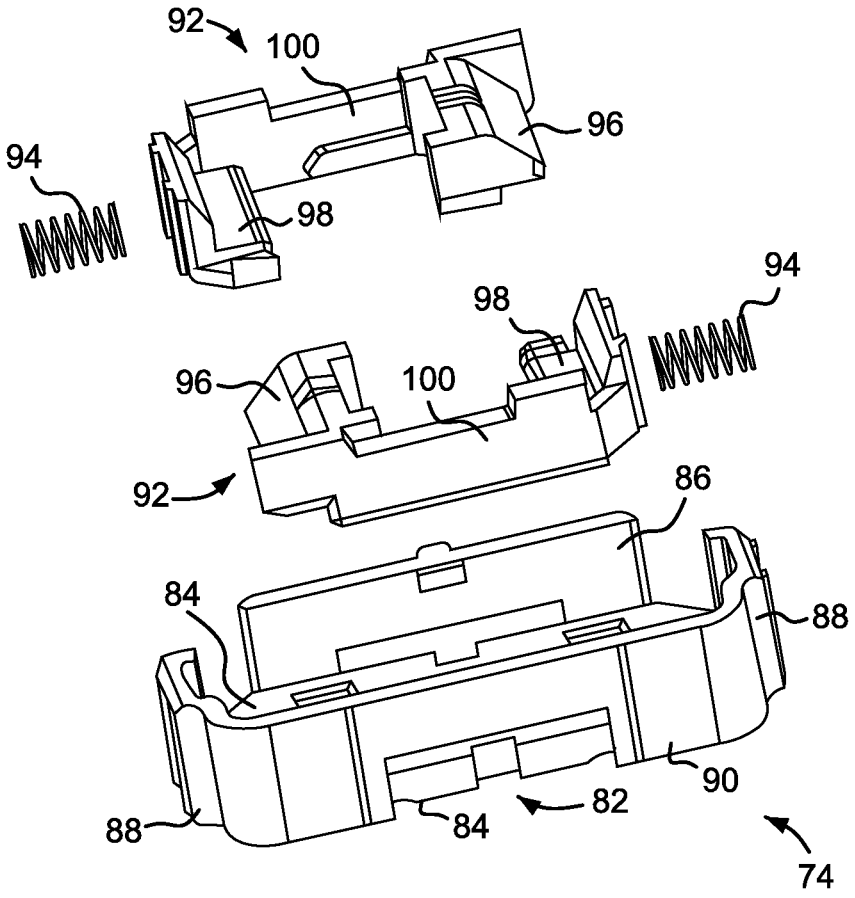
Figure 21:
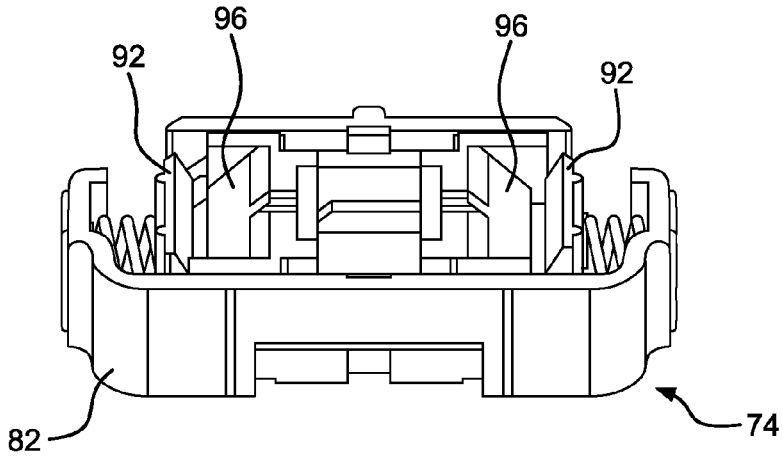
Figure 22:
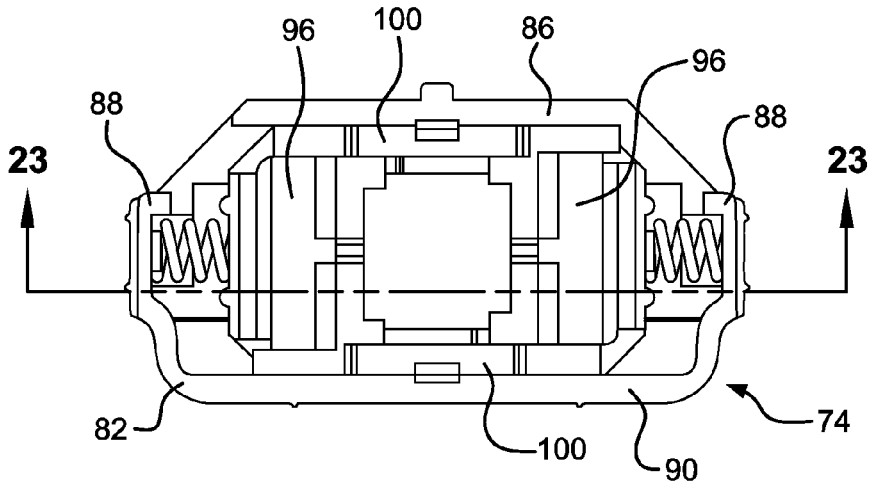
Figure 23:
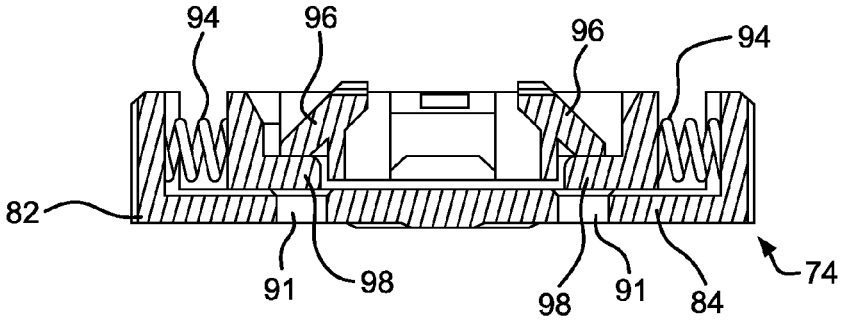

Referring to FIG. 19, a tamper-resistant assembly 74 for each outlet is secured to the underside of front cover 2 between the phase blade and neutral blade face openings 6, 4 and the phase and neutral contacts 36, 32. Each tamper-resistant assembly 74 is snapped into place and held in a recess defined by two end walls 76, an inner wall 78 and an outer wall 80 that are integrally molded with front cover 2. The purpose of the tamper-resistant assemblies is to minimize the risk of electric shock by inhibiting or preventing access to the contacts 32, 36 by anything other than an electrical plug, i.e., allowing access only by the prongs of an electrical plug that are simultaneously inserted into the face openings 4, 6.

The structure of each tamper-resistant assembly 74 is depicted in FIGS. 20-23. A cradle 82 is defined by a generally trapezoidal bottom wall 84, a short side wall 86, end walls 88 and a long side wall 90 joined to end walls 88. Slots 91 in bottom wall 84 are aligned with face openings 4, 6 in front cover 2 and with contacts 32, 36 in base 12. Slidable within cradle 82 are two complementary shutters 92, each biased by a coil spring 94 captured at one end wall 88 toward the opposite end wall 88. Each shutter 92 has a cam surface 96 and a blocking step 98 interconnected by a side panel 100. In the at-rest positions shown in the figures, the cam surface 96 of each shutter is positioned in front of the blocking step 98 of the other shutter, which blocks an opening 91 in base 74. Concurrent insertion of two plug blades acts against the two cam surfaces 96 simultaneously to unblock both slots 91, allowing blade access to the contacts 32, 36. However, if only one shutter cam surface 96 is contacted by an inserted object, only that shutter will slide to move its blocking step away from the other slot 91, but that slot will remain blocked by the cam surface 96 of the other shutter.

Alternative outlet face opening arrangements according to the invention are depicted in FIGS. 25-31. The same reference characters used to denote the three face openings (4, 6, 8) and the centerlines (CL) of the first embodiment (FIG. 24) are used in connection with the other embodiments. Bus bars and contact separators for these alternative arrangements are not illustrated; however, those skilled in art can readily envision their configurations, which simply would have to accommodate the alternate locations of the face openings.

Figure 25:
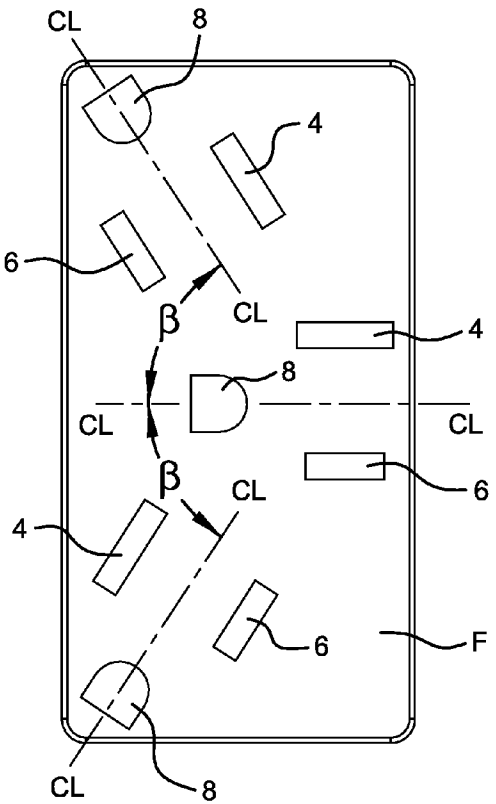

The arrangement of FIG. 25 is similar to that of the first embodiment, but the ground prong openings 8 of the corner outlets are slightly inboard of the corners, and are therefore laterally fully enclosed. Further, the centerlines of the corner outlets are angled more toward the center of the face, forming an angle β of about 60° with the centerline of the center outlet, whose centerline bisects the face as in the first embodiment.

Figure 26:
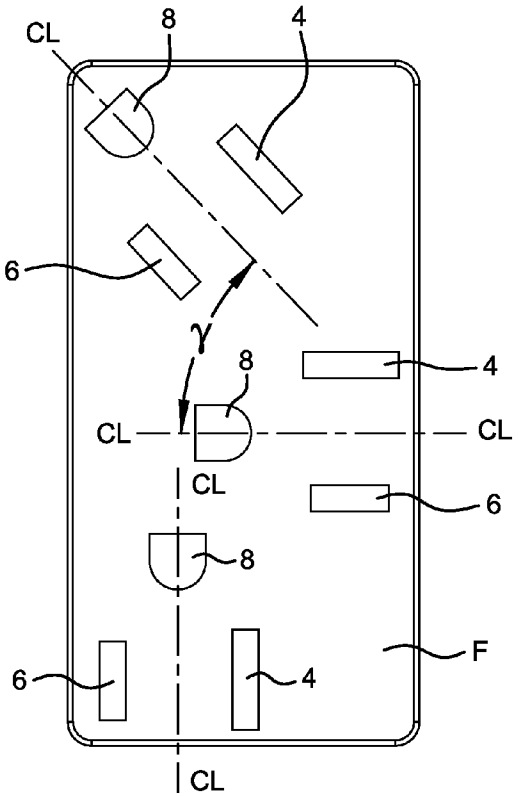

In the arrangement of FIG. 26, the centerline of the center outlet is parallel to the shorter edges of the face as in the first embodiment, but is displaced from the center of the face, away from the oblique upper corner outlet. That corner outlet has a laterally fully enclosed ground prong opening 8 slightly inboard of the corner, and a centerline that forms an angle γ of about 45° with the centerline of the center outlet. The centerline of the other (lower) corner outlet is perpendicular to that of the center outlet, and its ground prong opening 8 is further from the adjacent short edge of the face than its phase and neutral blade openings 6, 4.

Figure 27:
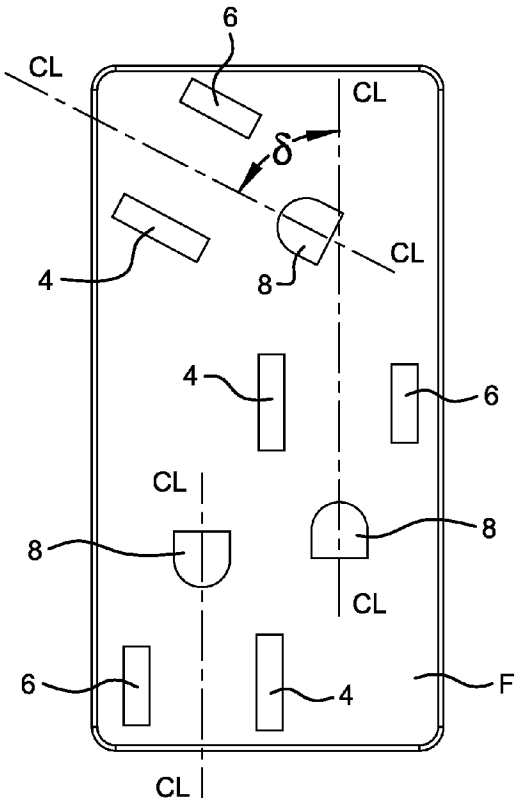

The arrangement of FIG. 27 is similar to that of FIG. 26, but the center outlet is turned 90° so that its centerline is parallel to the longer edges of the face, and parallel to that of the lower corner outlet. Also, the centerline of the upper corner outlet is angled further from the center of the face, forming an angle δ of about 65° with that of the center outlet.

Figure 28:
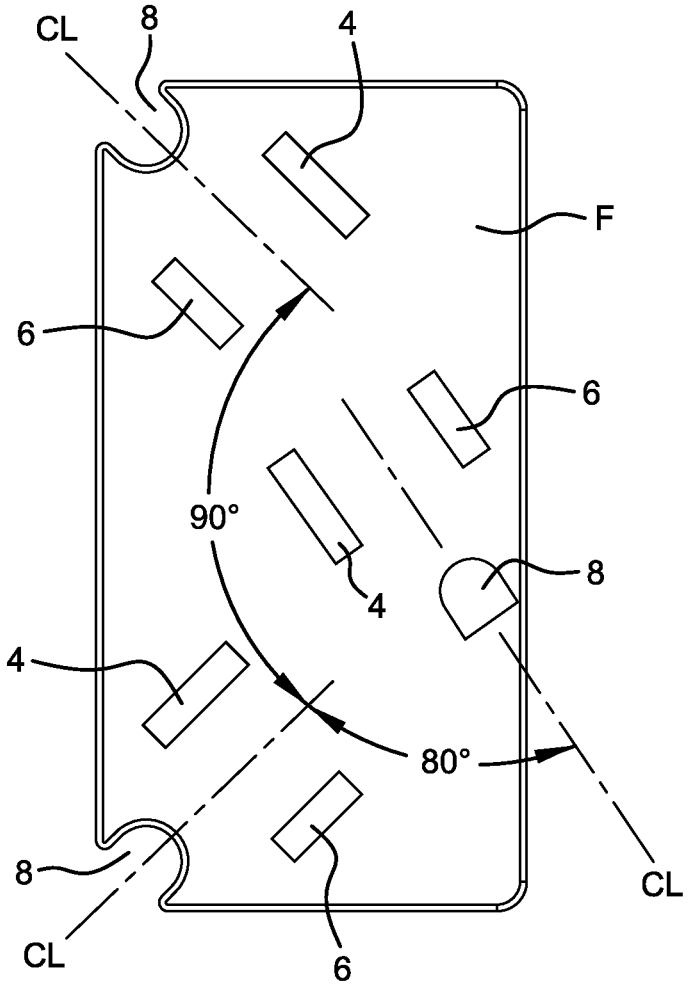

The arrangement of FIG. 28 is similar to that of the first embodiment (FIG. 24), but the center outlet is turned counterclockwise about 125° so that its centerline forms an angle of about 80° with that of the lower left outlet and an angle of about 10° with that of the upper left outlet, with its ground prong opening at the right edge of the face.

Figure 29:
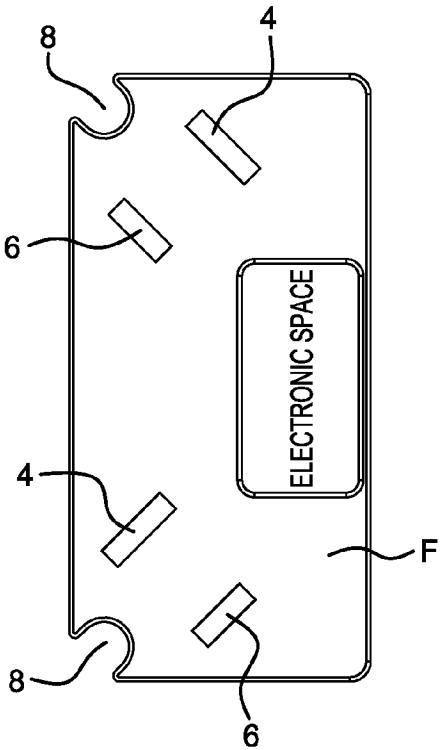

The embodiment of FIG. 29 is similar to the first embodiment, but it replaces the center outlet with an electronic space for housing an electrical device, which may have a user-accessible or visible interface on the face of the receptacle. Examples of such devices include, without limitation, a timer; a dimmer; a power monitoring device; a circuit breaker; a power indicator light; a signal port; an integral night light; an over-current protection device; a ground fault circuit interrupter (GFCI); and a transient voltage surge suppressor (TVSS).

Figure 30:
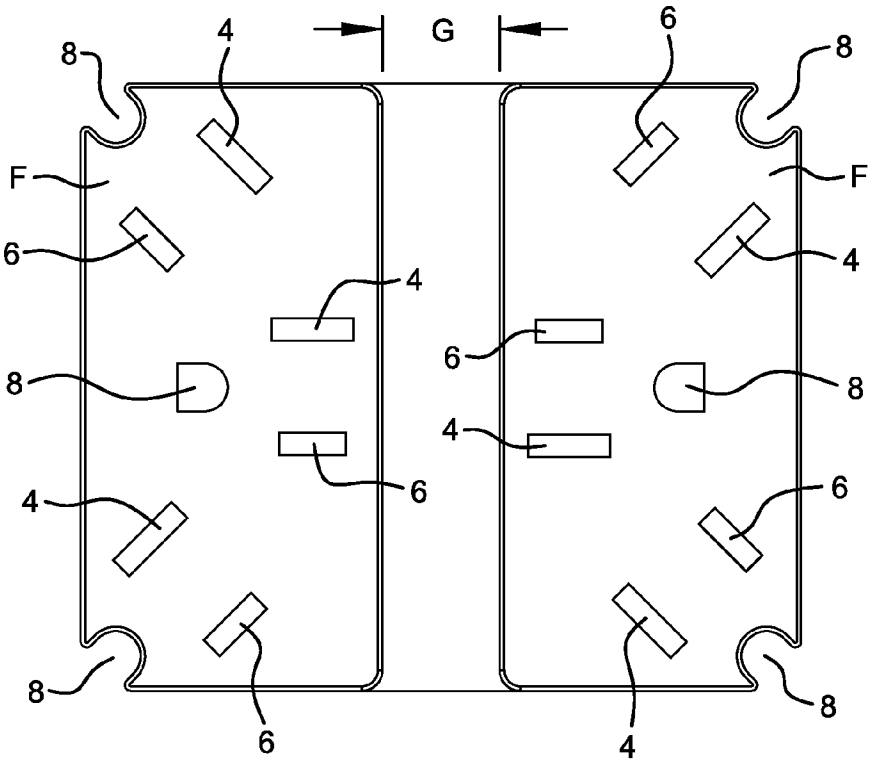

FIG. 30 depicts an arrangement providing six outlets housed in a receptacle body sized to fit in a NEMA-standard double wall box. Each face F is identical to that of the first embodiment in terms of its dimensions and its arrangement of openings 4, 6, 8. Preferably, there is a gap G of 0.502 in. between the faces so that the faces are 1.792 in. on center, and the overall width from the left edge of the left face to the right edge of the right face is 3.082 in. Single terminals on the body (not shown) are provided for attaching each of phase, neutral and ground line conductors. The phase and neutral bus bars and the ground straps associated with the two faces are interconnected by respective spot welded brass shunts or other welded conductors (not shown).

Figure 32:
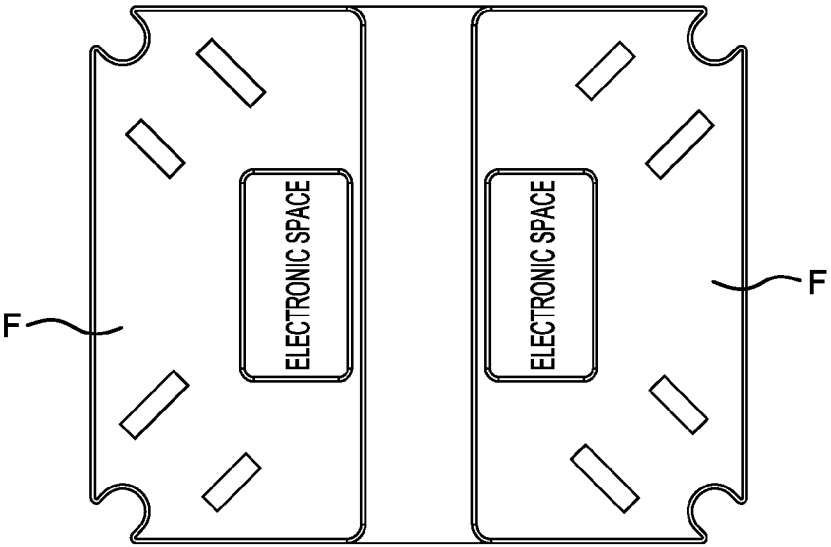
FIG. 32 is a schematic front view of an outlet face opening arrangement according to a ninth embodiment.
Figure 31:
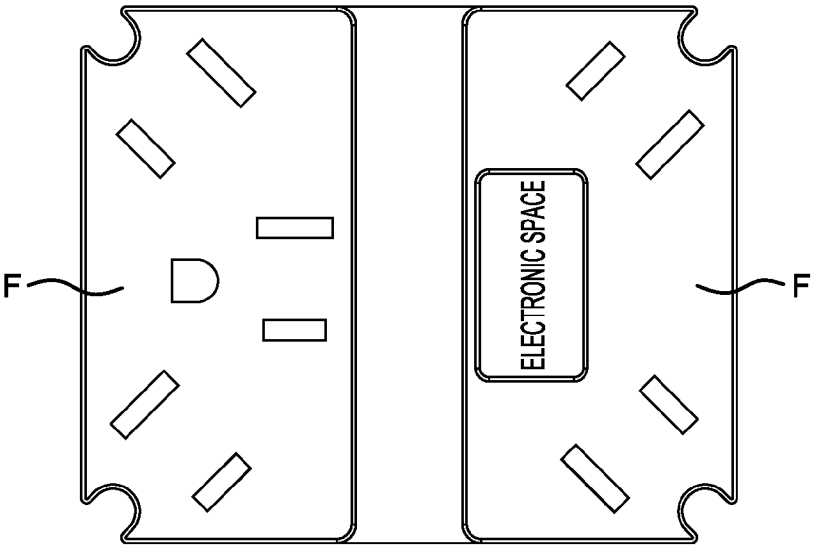
Figure 33:
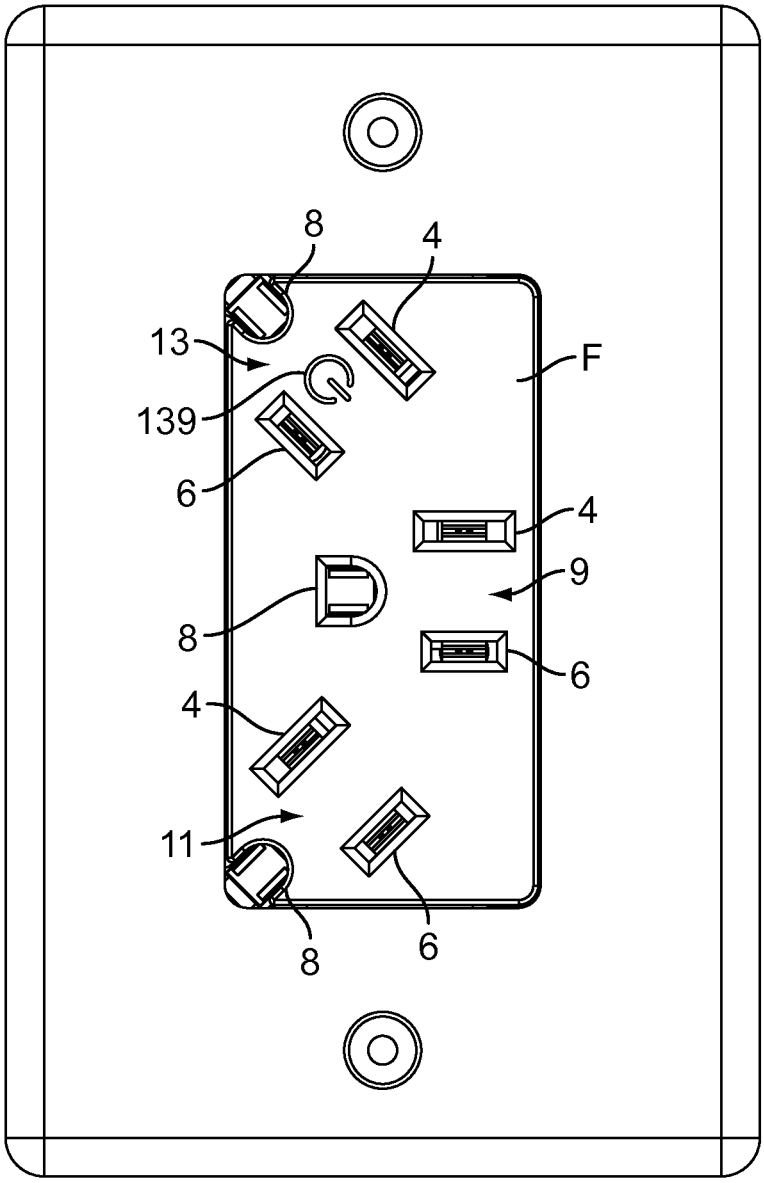
FIGS. 33-61 concern new embodiments that enable connection of at least one of the outlets to a separate circuit.

FIGS. 31 and 32 depict embodiments identical to that of FIG. 30, except that the electronic space feature of FIG. 29 is incorporated on one or both sides of the receptacle, respectively. In the embodiment of FIG. 31, the electronics spaces may house the same or different electrical devices.

The triplex receptacle embodiment of FIGS. 33-47 has the same body size and outlet blade opening arrangement as the embodiment of FIGS. 1-24, but is adapted for connection of one outlet to a separate circuit, which could be controlled by, for example, a current monitoring, energy saving device that turns off power to unattended loads. Common parts are designated by the same reference numbers used in FIGS. 1-24.

The separate circuit capability of this embodiment is afforded by its bus bar and terminal configuration, which is best seen in FIGS. 41-47. Three neutral contacts 132 (one for each outlet 9, 11, 13—see FIG. 33) are riveted or otherwise secured to a common neutral bus bar 134, which has a neutral terminal 120 for connection to a common neutral line conductor. Phase contact 136 (for center outlet 9) and phase contact 137 (for first corner outlet 11) are riveted or otherwise secured to a first phase bus bar 138, which has a terminal 122 for connection to the phase conductor of a first circuit. Phase contact 133 (for second corner outlet 13) is riveted or otherwise secured to a second (separate) phase bus bar 135, which has its own terminal 123 for connection to the phase conductor of a second circuit. An identifying symbol 139, which can be molded into the face F at the factory or be applied as a label at installation, indicates the separately powered, switch-controlled outlet 13. If the receptacle is wired for switch control of outlets 9 and 11 instead, only those two outlets would be so labeled. If electrical isolation of outlet 13 from the others is not desired, it is a simple matter to place all outlets on the same circuit by bridging phase terminals 122, 123 with an external jumper wire or by directly connecting each of them to the phase conductor of a single circuit.

Bus bars 134, 135 and 138 are flat brass stampings. An insulating plastic contact separator 140 fits within base 112 and has a bottom wall 142 and upstanding dividers 144 that insulate the phase and neutral bus bars and contacts from one another. Base 112 has a bottom wall 146; a central upstanding side wall 148 at the neutral terminal 120 and first phase terminal 122 side of the receptacle; an upstanding side wall 150 at the opposite side of the receptacle defining a gap 152 in which ground terminal 118 (of ground strap 116) resides and a gap 153 in which second phase terminal 123 resides; and upstanding end walls 154. Side wall 148 and end walls 154 define two gaps 156, 158. Neutral bus bar 134, which is substantially identical to neutral bus bar 34 of the first embodiment (see FIGS. 14-16), is disposed above the bottom wall 142 of contact separator 140. The upstanding portion 160 of neutral bus bar 134 runs lengthwise of the receptacle behind side wall 148, with neutral terminal 120 exposed in gap 158; then obliquely at 161; and then obliquely in the reverse direction at 162, ending in a right-angle tab **162*a* that supports neutral contact 132 of first corner outlet 11. A short arm 163 at the other end of neutral bus bar 134 extends transversely toward neutral contact 132 of second corner outlet 13, terminating in an oblique tip 163*a*. A short intermediate transverse arm 164 connects to neutral contact 132 of center outlet 9**.

Y-shaped first phase bus bar 138 is disposed between the bottom wall 142 of contact separator 140 and the bottom wall 146 of base 112, with first phase terminal 122 residing in gap 156. One branch **138*a* of first phase bus bar 138 extends obliquely to phase contact 137 of first corner outlet 11; the other branch 138*b* extends longitudinally to phase contact 136 of center outlet 9, crossing beneath oblique portion 161 of neutral bus bar 134. Second phase bus bar 135 also is disposed between the bottom wall 142 of contact separator 140 and the bottom wall 146 of base 112, and extends obliquely a short distance to phase contact 133 of second corner outlet 13**.

Figure 34:
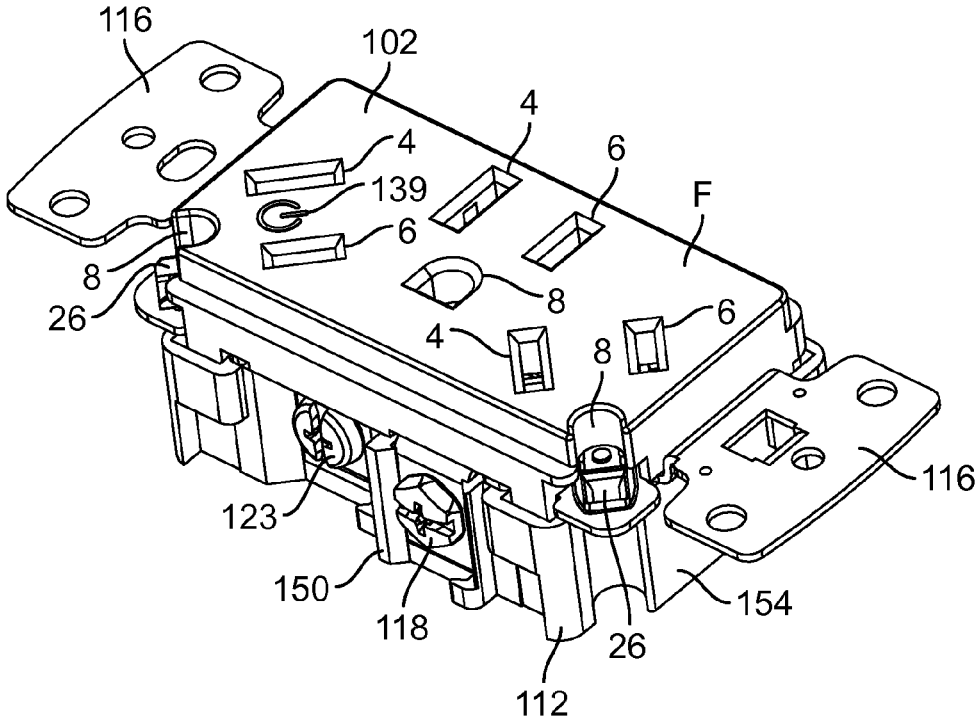
Figure 35:
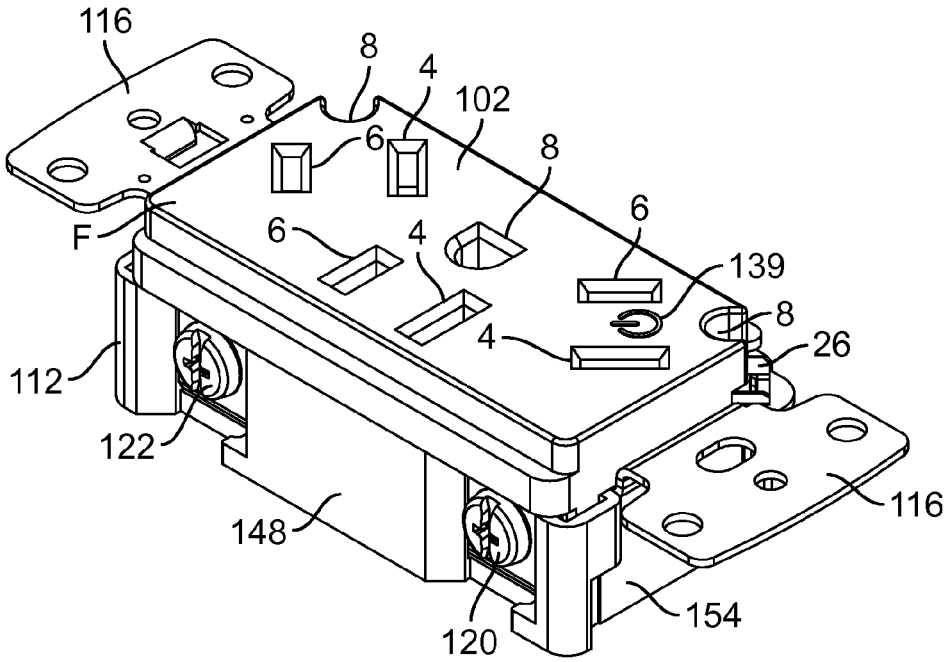
Figure 36:
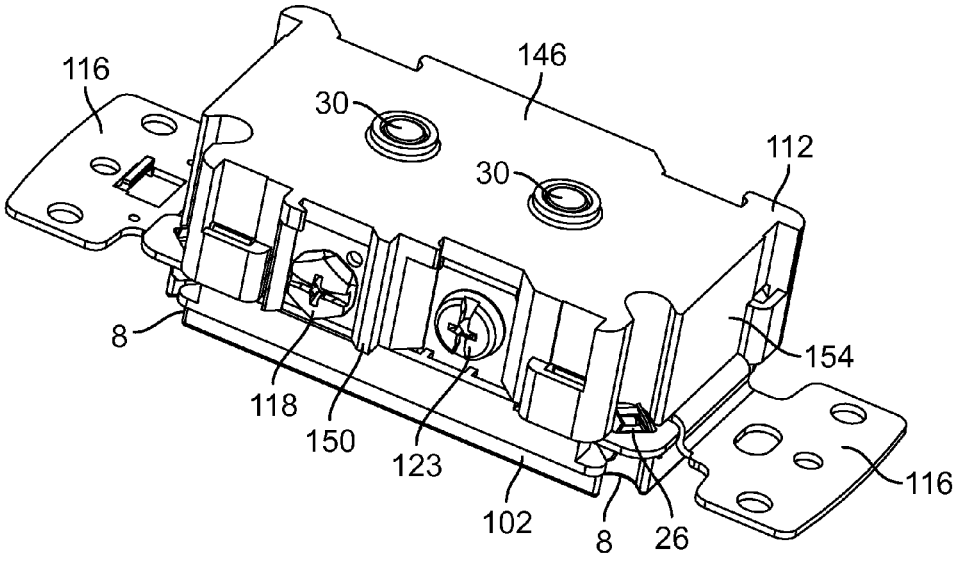
Figure 37:
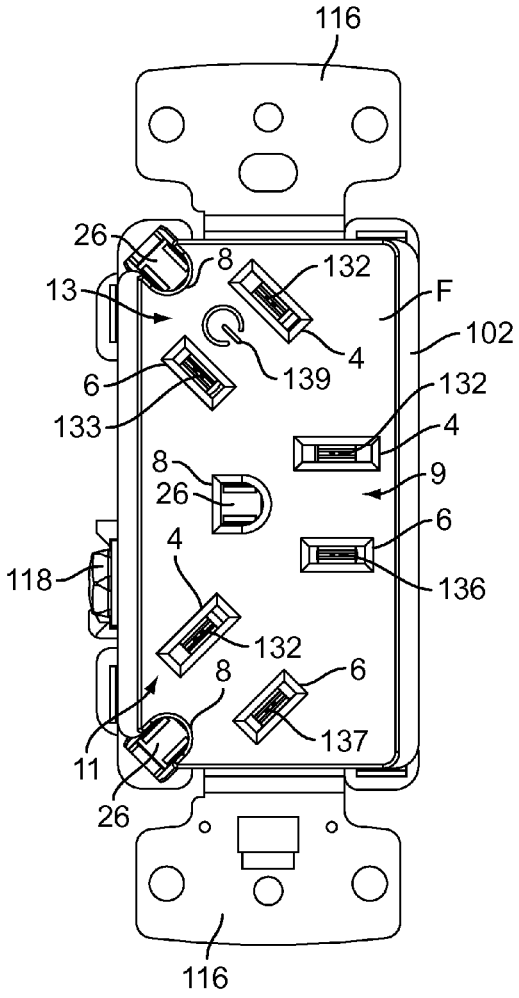
Figure 38:
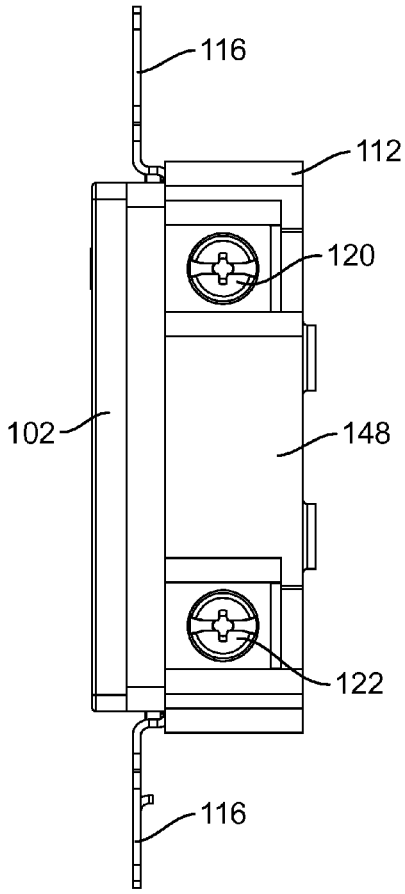
Figure 39:
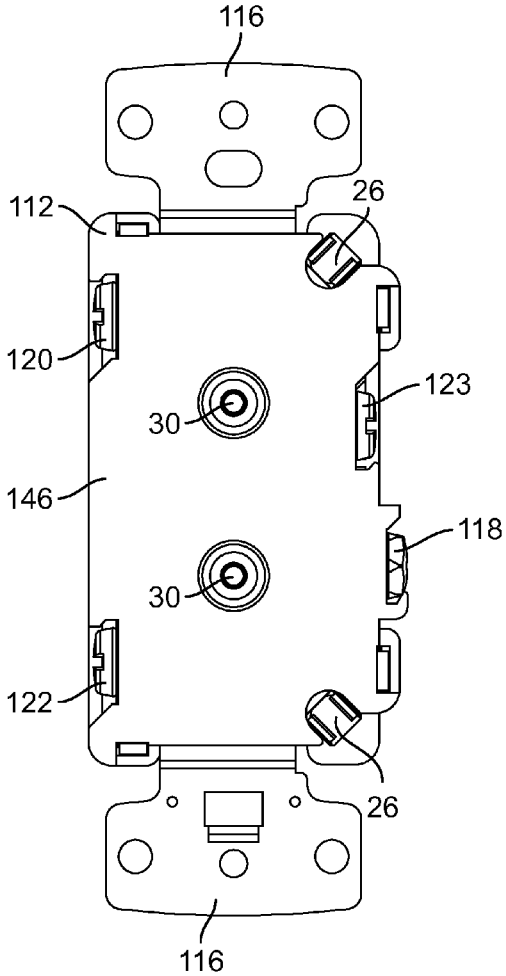
Figure 40:
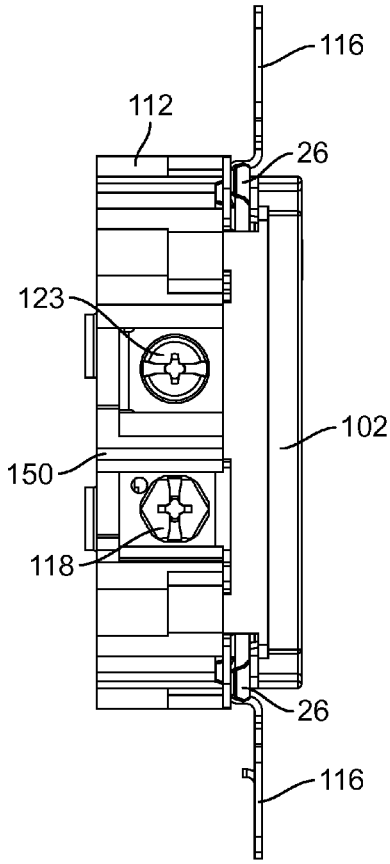
Figure 41:
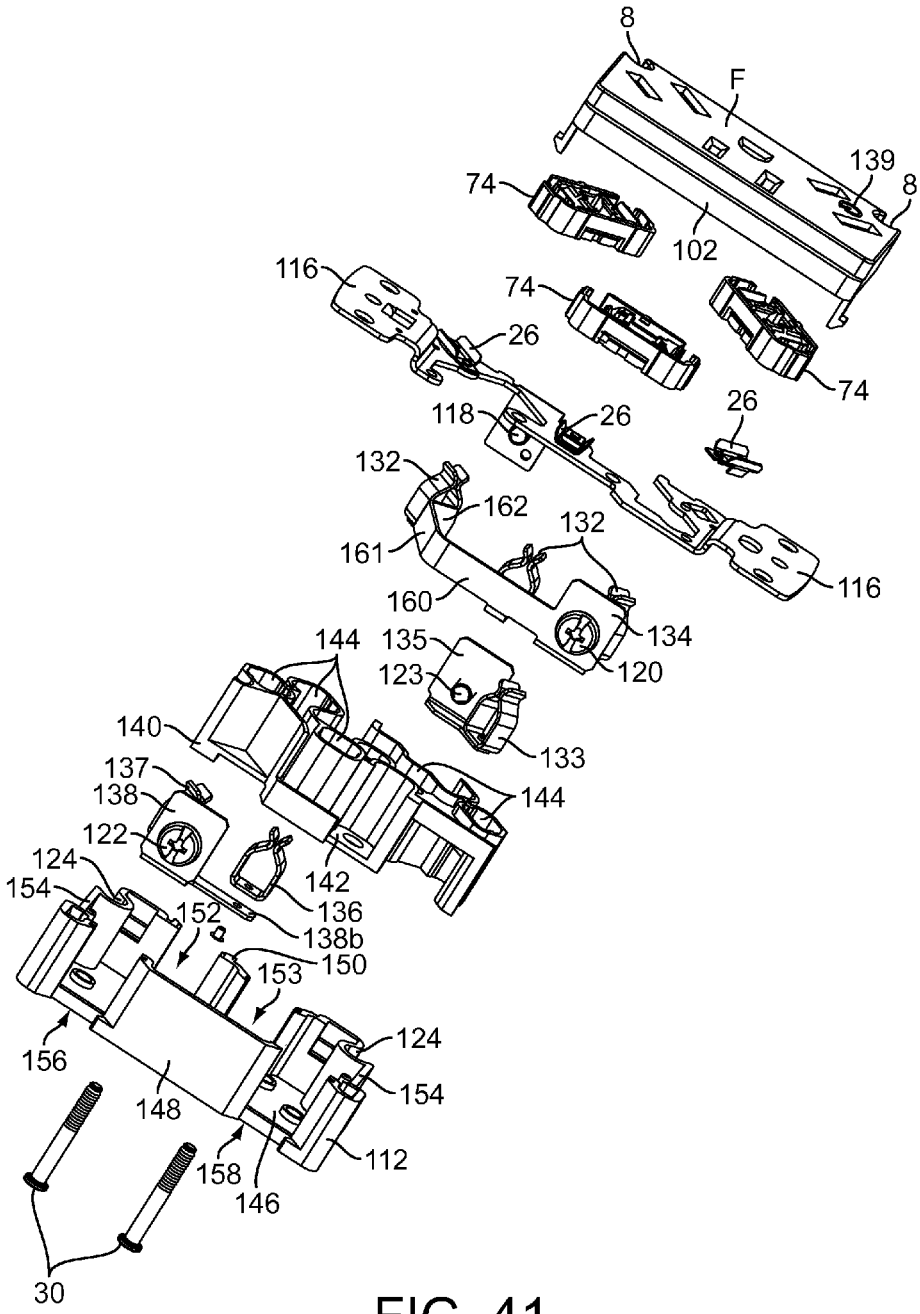
Figure 42:
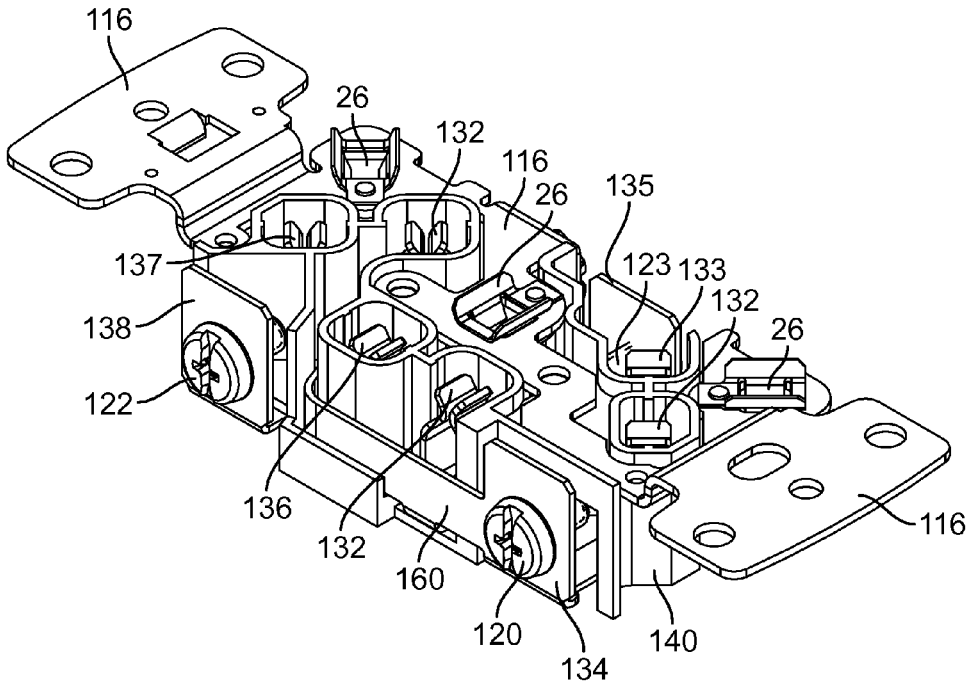
Figure 43:
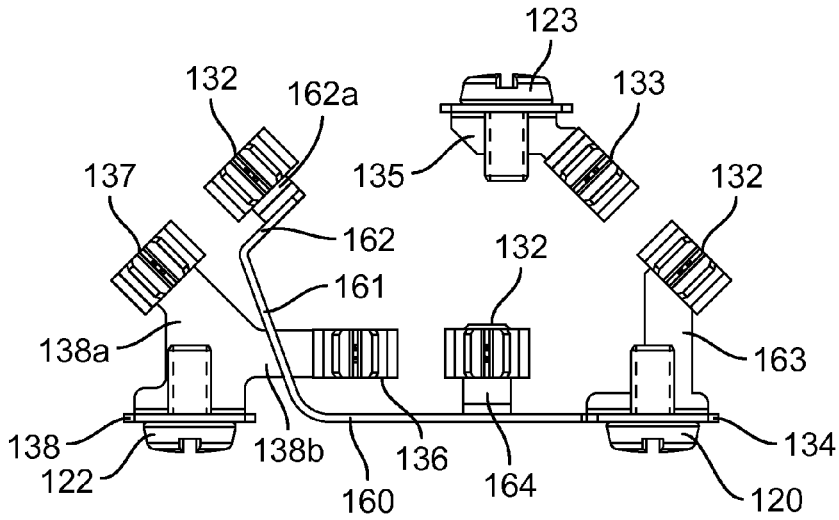
Figure 44:
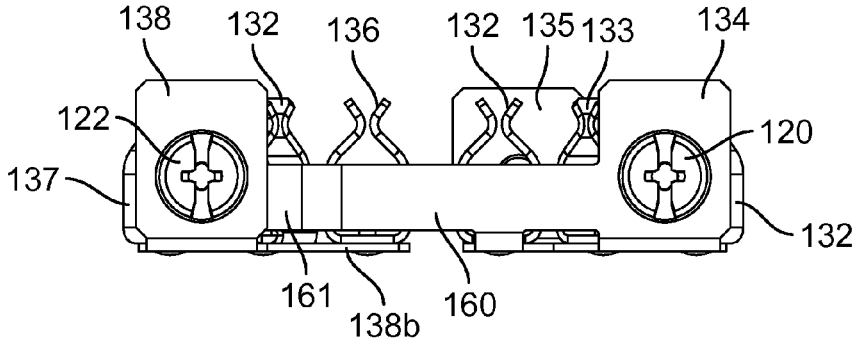
Figure 45:
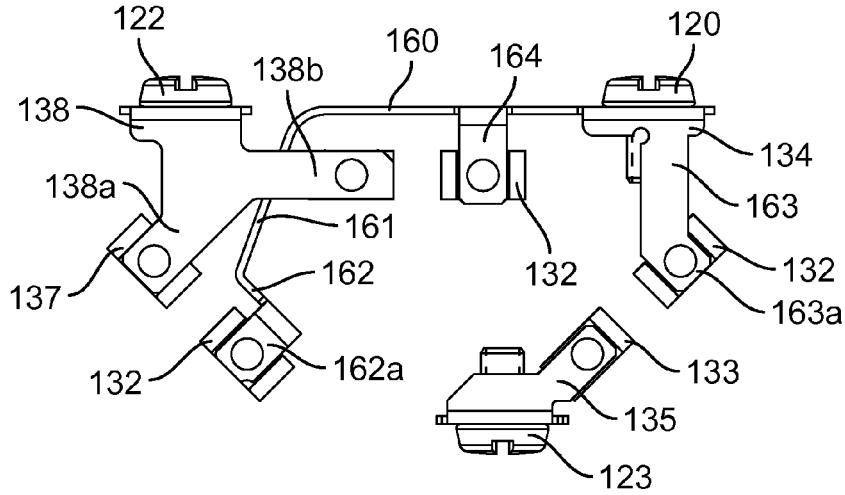
Figure 46:
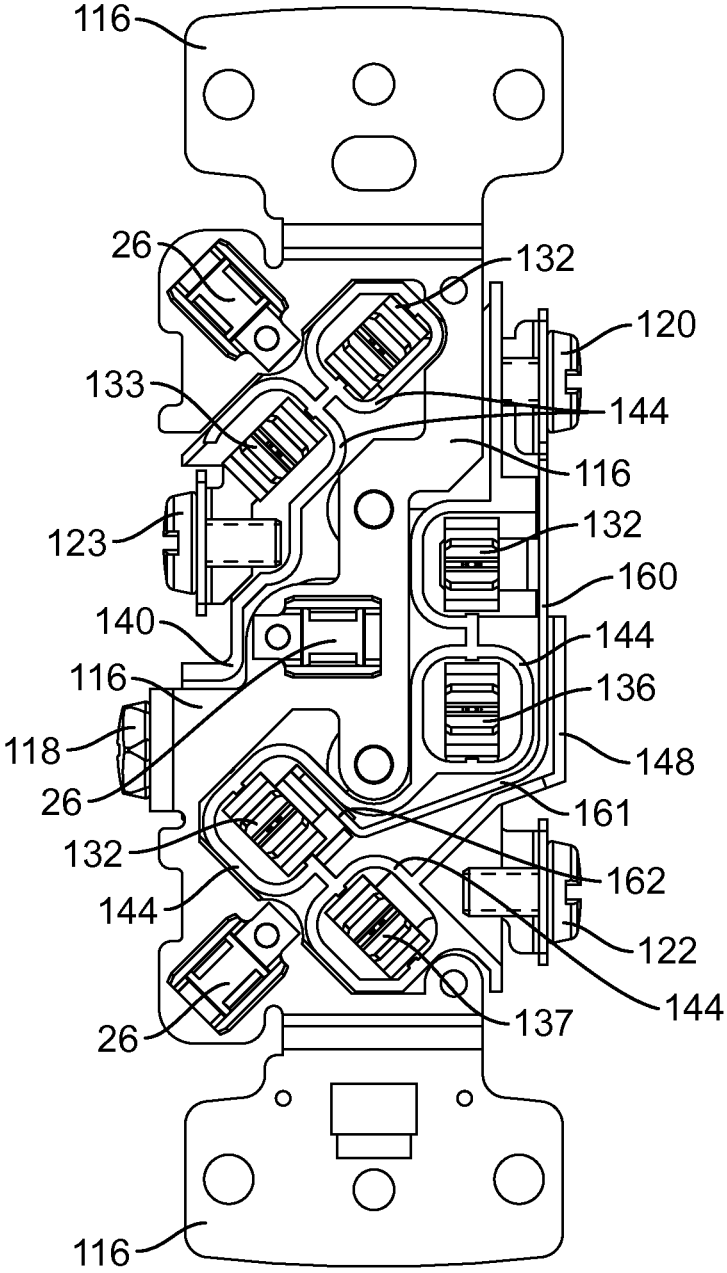
Figure 47:
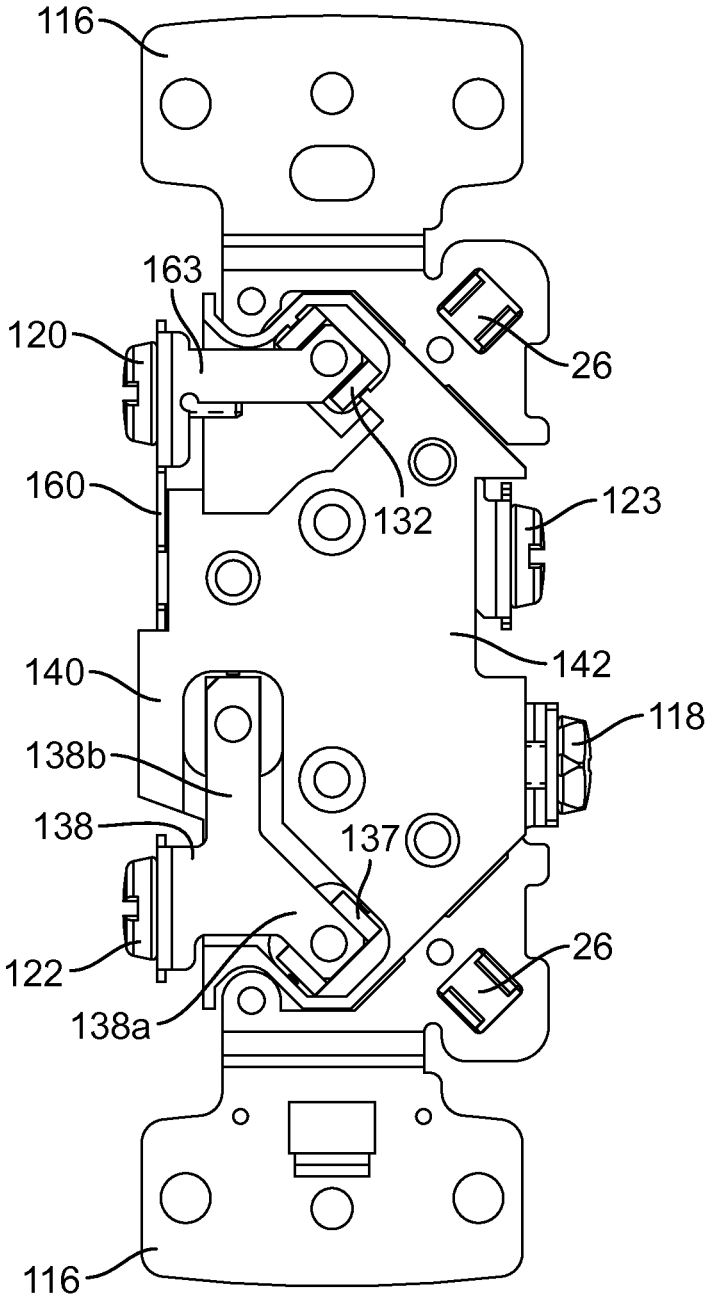
Figure 48:
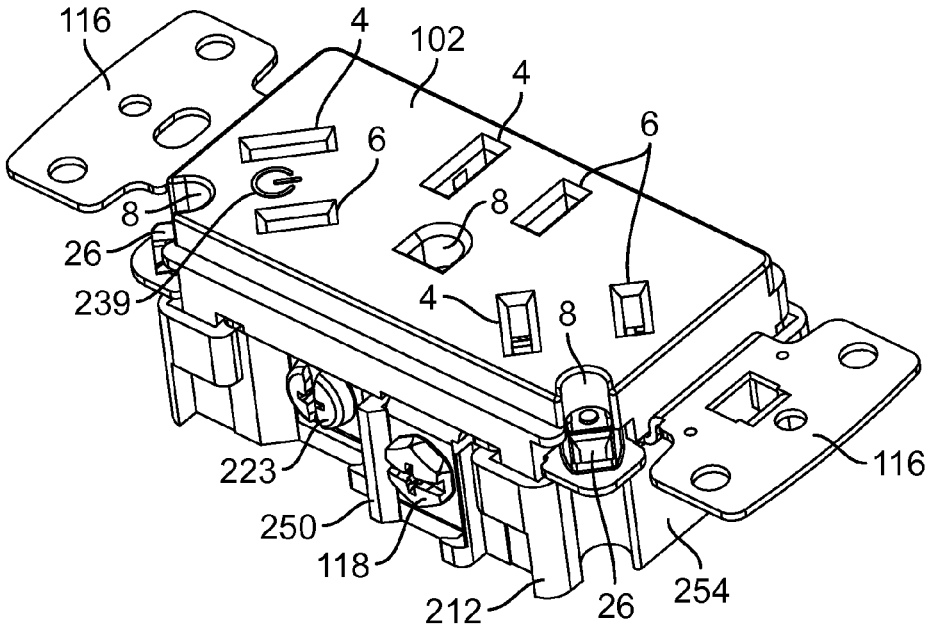
Figure 49:
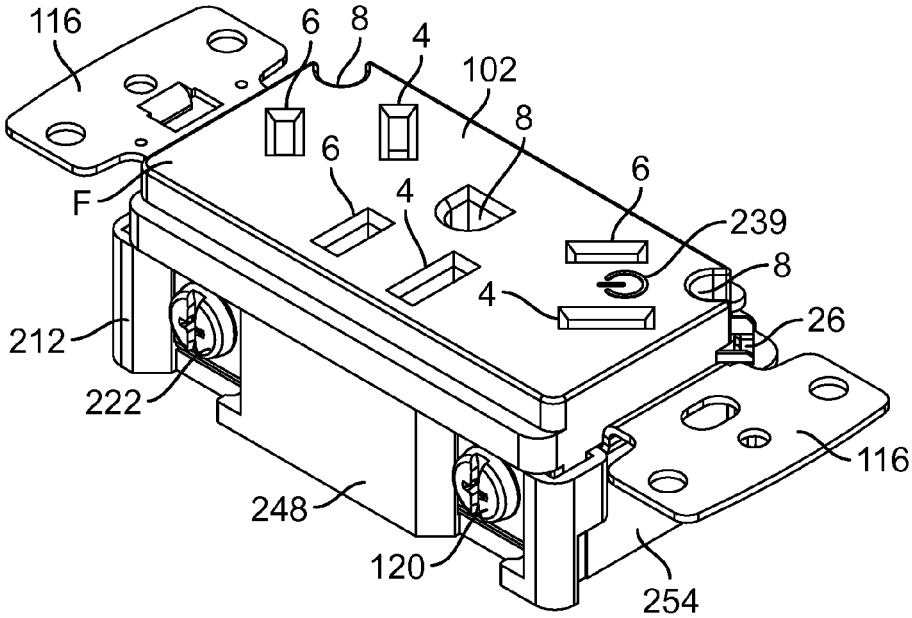
Figure 50:
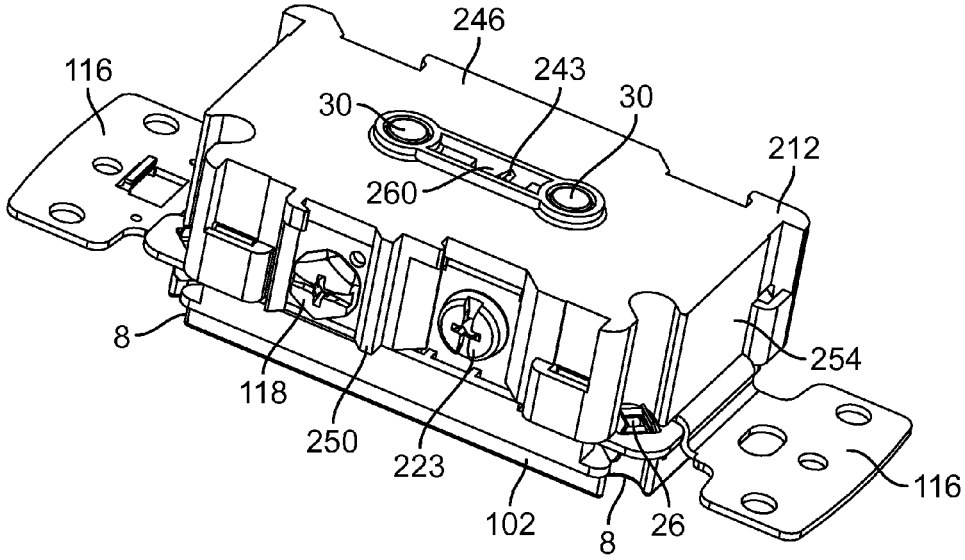
Figure 51:
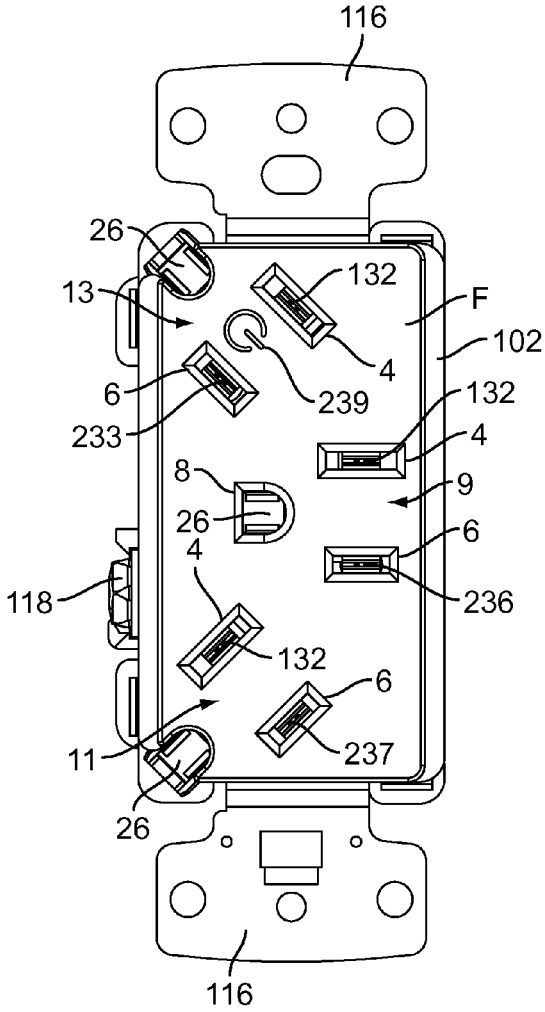
Figure 52:
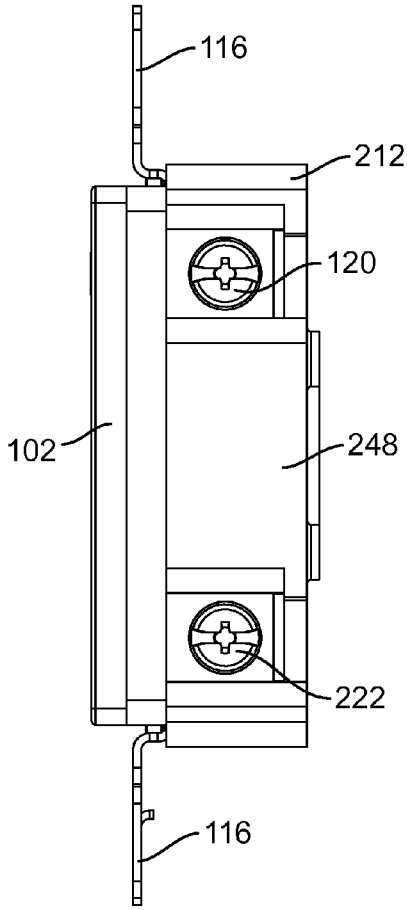
Figure 53:
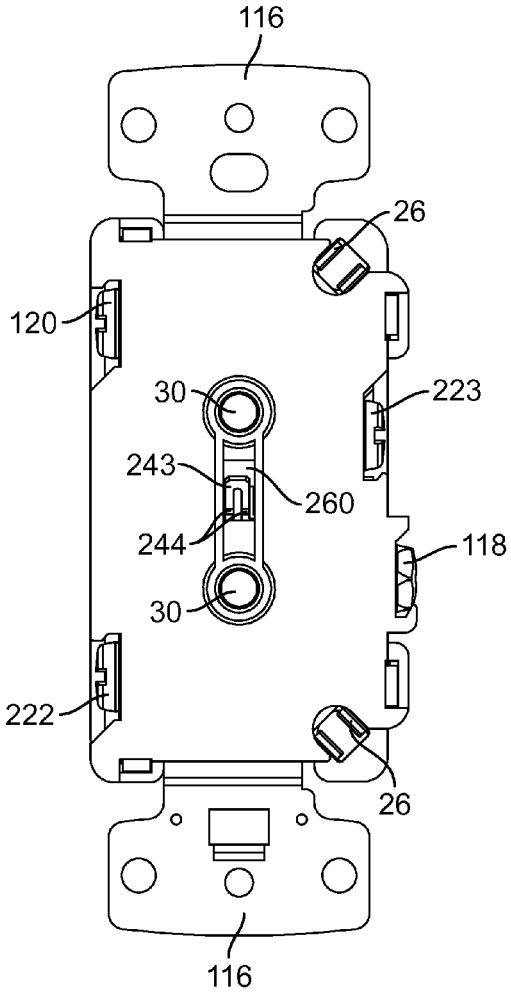
Figure 54:
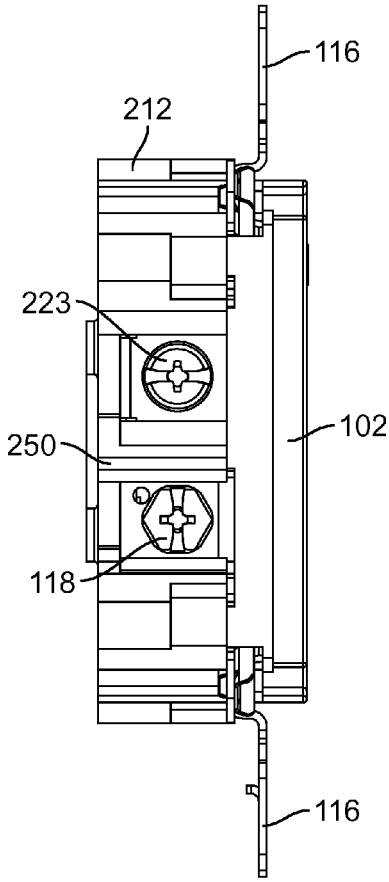
Figure 55:
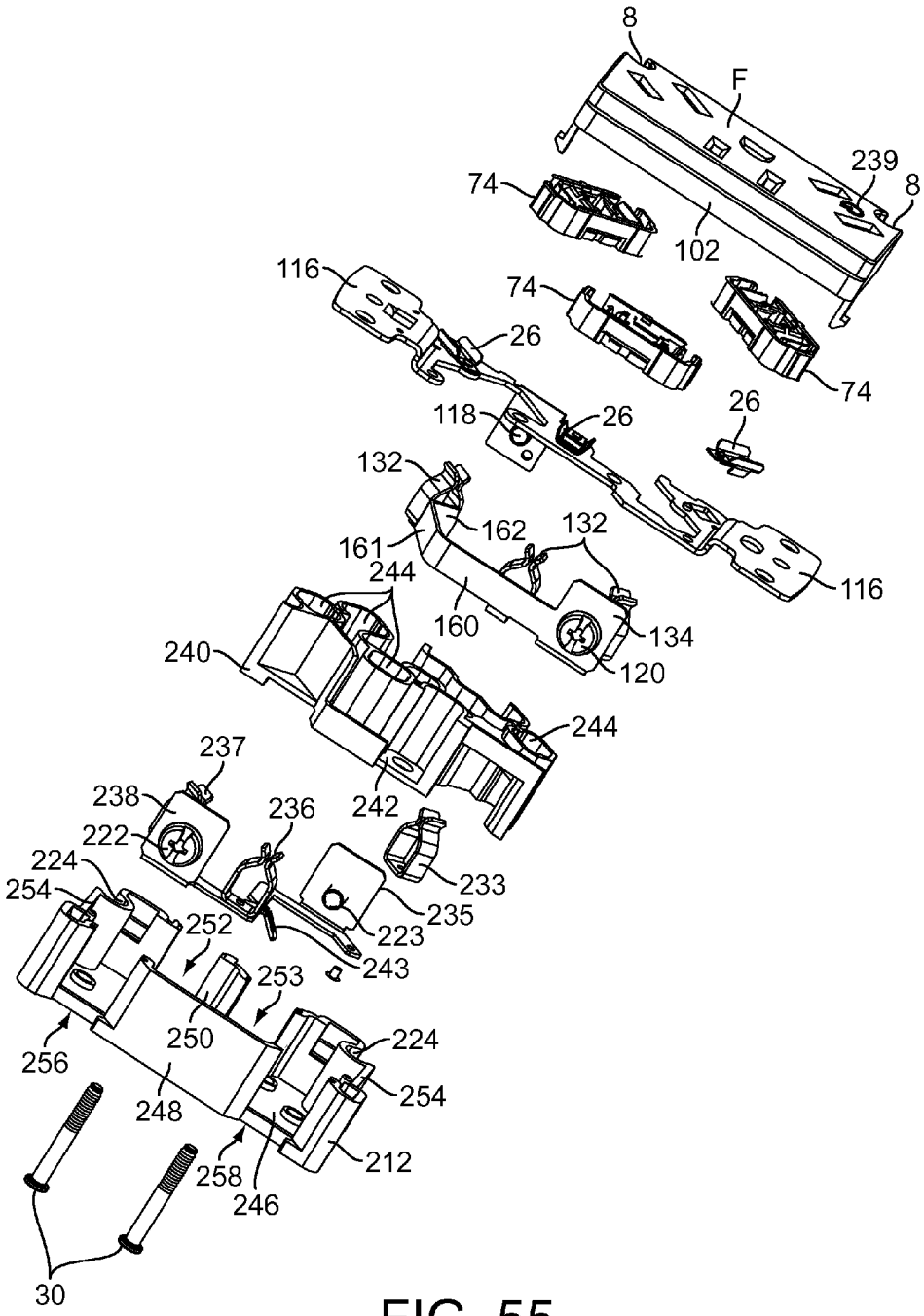
Figure 56:
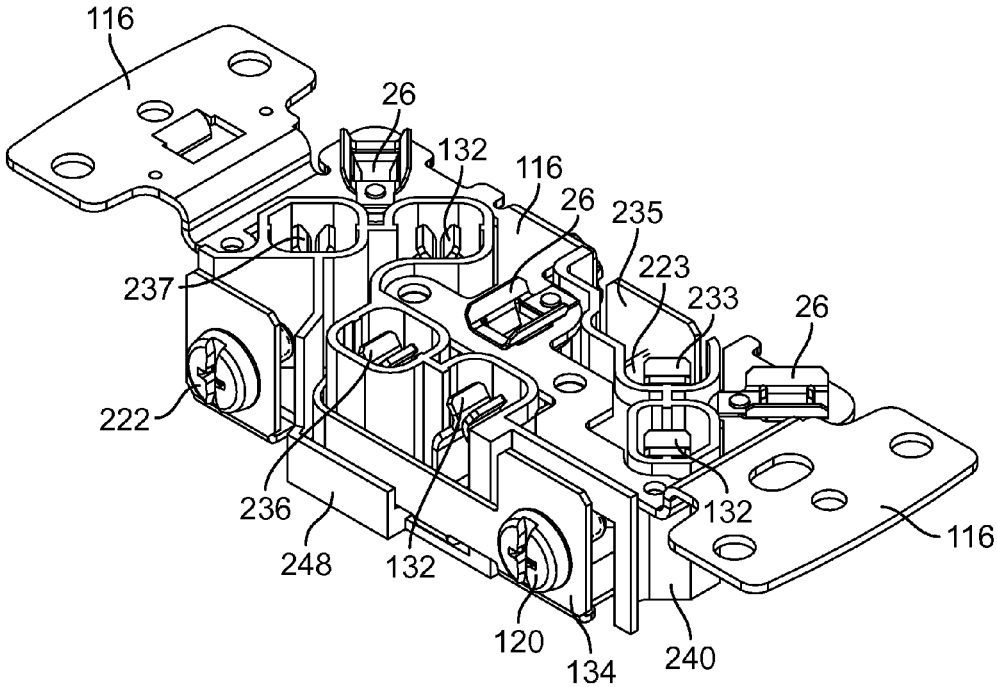
Figure 57:
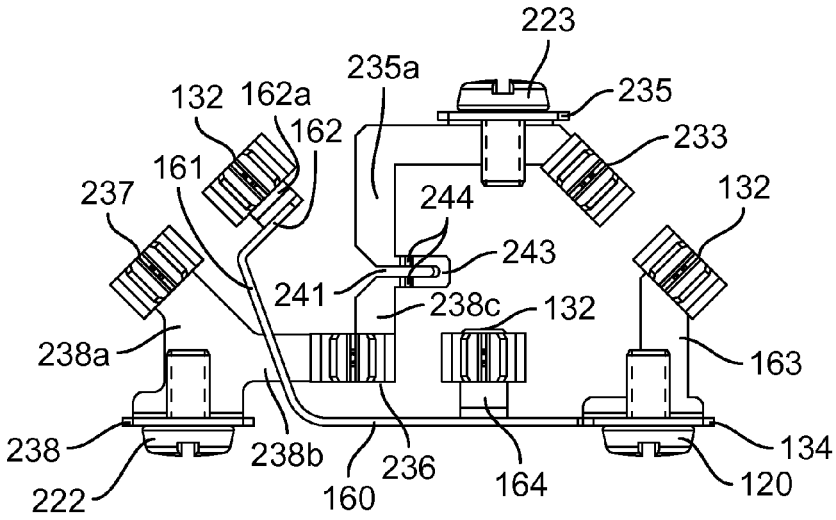
Figure 58:
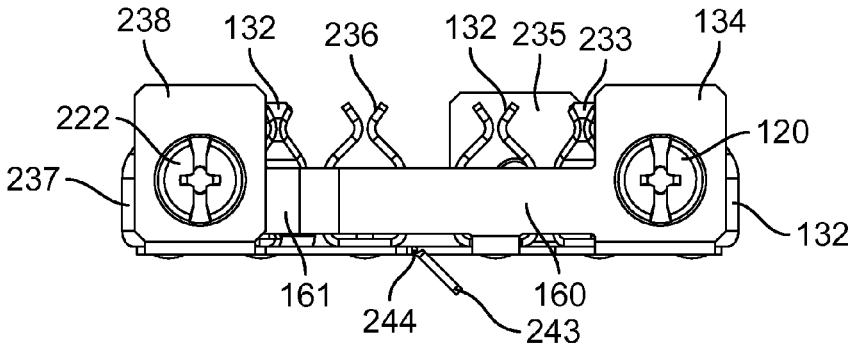
Figure 59:
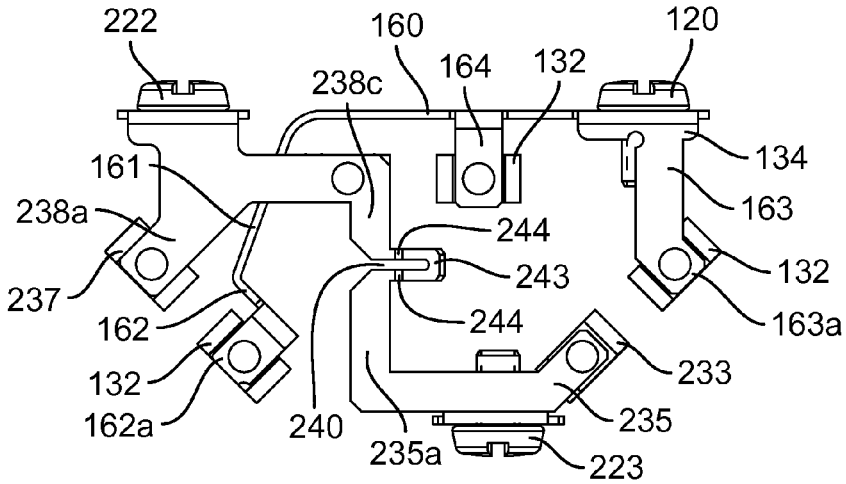
Figure 60:
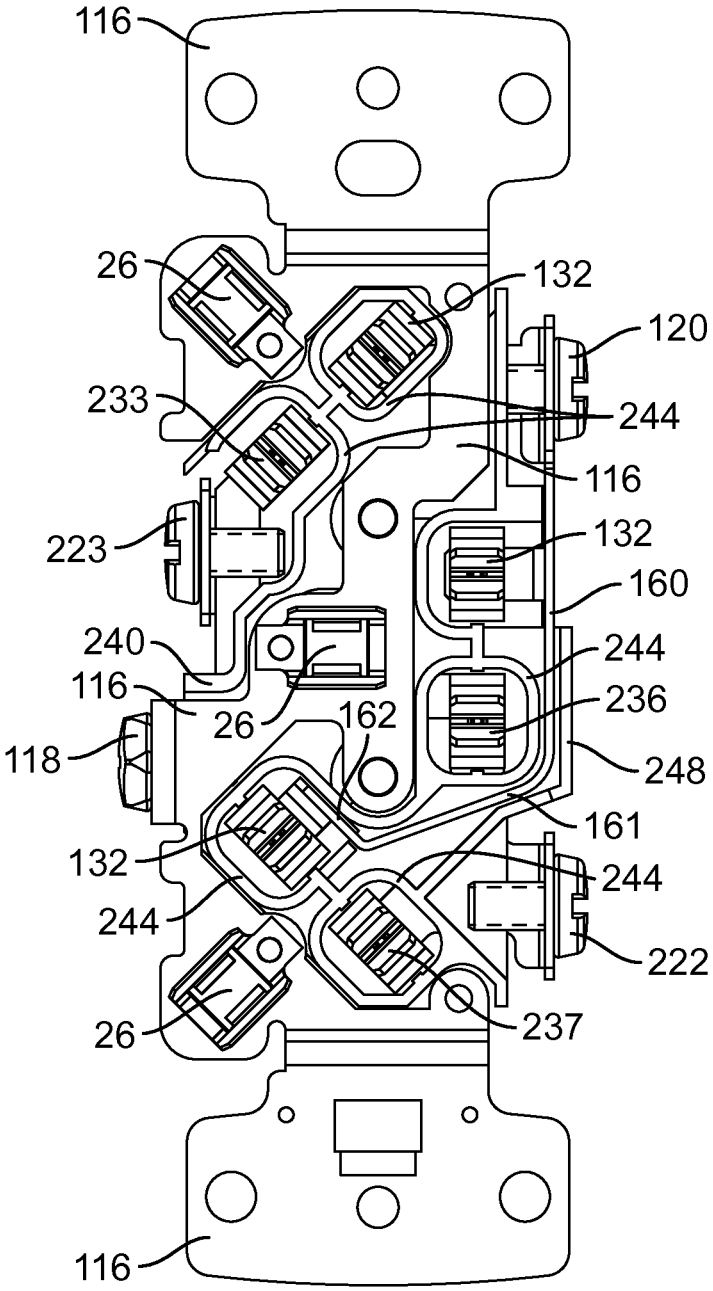
Figure 61:
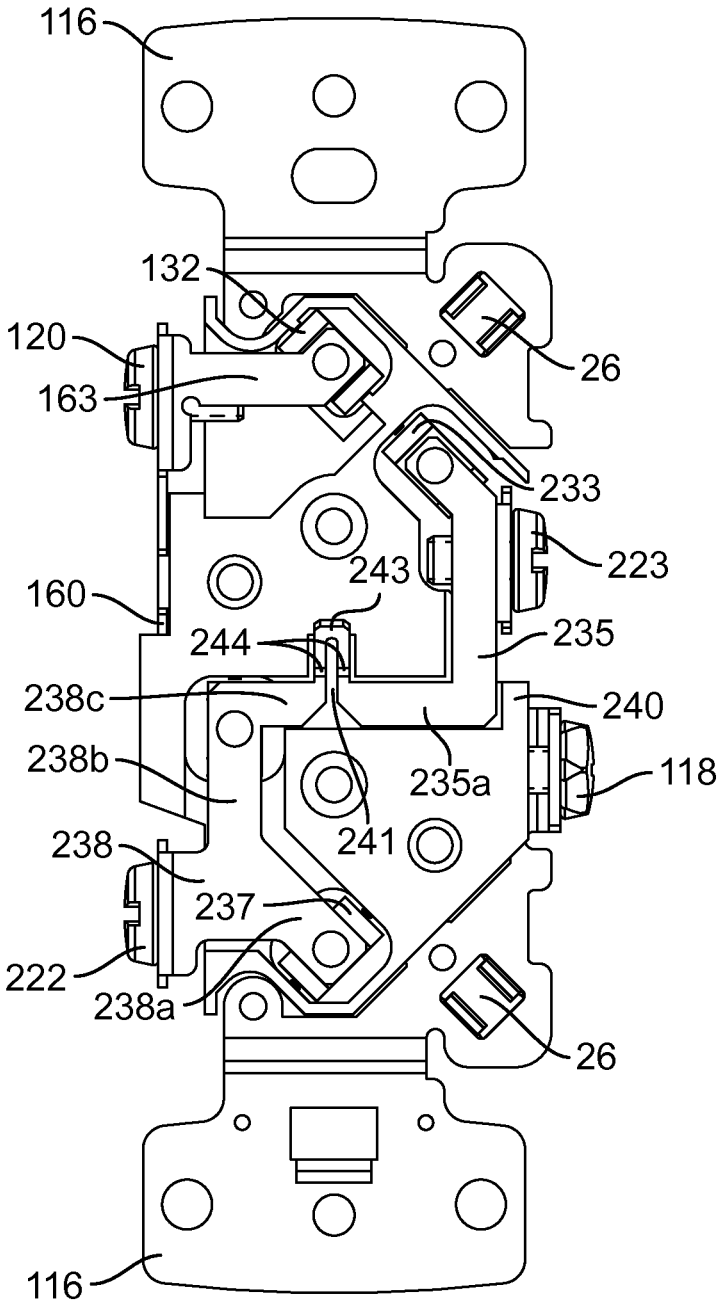

FIGS. 48-61 show another embodiment of a triplex receptacle adapted for connection of one outlet to a separate circuit. This embodiment, too, has the same body size and outlet blade opening arrangement as the embodiment of FIGS. 1-24, and is identical in many respects to the embodiment of FIGS. 33-47. Common parts are designated by the same reference numbers used in FIGS. 1-24 and 33-47. Commonality is evident from the following pairs of substantially identical figures: FIGS. 34 and 48; FIGS. 35 and 49; FIGS. 37 and 51; FIGS. 42 and 56; and FIGS. 46 and 60. The face F of the receptacle of FIGS. 48-61 has the appearance shown in FIG. 33, but the separate circuit symbol has a different meaning because the outlet it denotes is initially electrically connected internally to the other outlets. Thus, symbol 239 on the face of the embodiment of FIGS. 48-61 identifies the outlet that can be isolated, if desired, when the receptacle is installed. The major structural differences are in the arrangement of the phase bus bars and the adjacent parts of the base 212, as described below.

Referring to FIGS. 55-61, three neutral contacts 132 (one for each outlet 9, 11, 13) are riveted or otherwise secured to a common neutral bus bar 134, which has a neutral terminal 120 for connection to a common neutral line conductor. Neutral bus bar 134, which is substantially identical to the neutral bus bars of the other embodiments, is disposed above the bottom wall 242 of insulating contact separator 240, which fits within base 212 above its bottom wall 246 and has upstanding dividers 244 that insulate the phase and neutral bus bars and contacts from one another. The upstanding portion 160 of neutral bus bar 134 runs lengthwise of the receptacle behind central upstanding side wall 248 of base 212; then obliquely at 161; and then obliquely in the reverse direction at 162, ending in a right-angle tab 162*a* that supports neutral contact 132 of first corner outlet 11. A short arm 163 at the other end of neutral bus bar 134 extends transversely toward neutral contact 132 of second corner outlet 13, terminating in an oblique tip 163*a*. A short intermediate transverse arm 164 connects to neutral contact 132 of center outlet 9. Neutral terminal 120 resides in a gap 258 defined by base side wall 248 and a base end wall 254. Ground terminal 118 (of ground strap 116) resides in a gap 252 at the opposite side of the receptacle adjacent central upstanding base side wall 250.

Phase contact 236 (for center outlet 9) and phase contact 237 (for first corner outlet 11) are riveted or otherwise secured to a first phase bus bar 238, which has a terminal 222 for connection to the phase conductor of a first circuit. Terminal 222 resides in a gap 256 defined by base side wall 248 and a base end wall 254. Phase contact 233 (for second corner outlet 13) is riveted or otherwise secured to a second phase bus bar 235, which has its own terminal 223 for connection to the phase conductor of a second circuit, if desired. Terminal 223 resides in a gap 253 at the opposite side of the receptacle adjacent central base side wall 250. First phase bus bar 238 is disposed between the bottom wall 242 of contact separator 240 and the bottom wall 246 of base 212. One branch 238*a* of first phase bus bar 238 extends obliquely to phase contact 237 of first corner outlet 11; the other branch 238*b* extends longitudinally to phase contact 236 of center outlet 9, crossing beneath oblique portion 161 of neutral bus bar 134. Second phase bus bar 235 also is disposed between the bottom wall 242 of contact separator 240 and the bottom wall 246 of base 212, and extends obliquely a short distance to phase contact 233 of second corner outlet 13.

First and second phase bus bars 238, 235 initially are electrically connected through a frangible connection. First phase bus bar 238 has a transverse tongue 238*c* extending from phase contact 236 almost to the longitudinal center of the receptacle. Second phase bus bar 235 has a preferably L-shaped extension with a transverse tongue 235*a*, which also extends almost to the longitudinal center of the receptacle. The two tongues 235*a*, 238*c* are aligned with a gap 241 between their distal ends. Gap 241 is bridged by a break-off tab 243 having weakened sections 244 that enable tab 243 to be removed using an appropriate hand tool, typically during installation of the receptacle, if electrical isolation of one outlet from the others is desired. Break-off tab 243 is accessible for this purpose through a window 260 in the bottom wall 246 of base 212 (see FIGS. 50 and 53). All parts of first and second phase bus bars 238, 235 and break-off tab 243 preferably are fabricated together as one piece thus effectively forming, initially, a single phase bus bar having two terminals 222, 223.

While various embodiments have been chosen to illustrate the invention, it will be understood by those skilled in the art that various changes and modifications may be made without departing from the scope of the invention as defined by the appended claims. By way of example only, while the faces F and bus bar arrangements of the various embodiments have been described as preferably being dimensioned to comply with the ANSI/NEMA WD 6 (R2008) dimensional standard for popular "decorator" style wiring devices, any of the specifically disclosed face and/or bus bar arrangements, or any other arrangement within the scope of the claims, can be used in receptacles having faces of other sizes. Furthermore, standard quick-connect insertion-type terminals may be provided at the rear of the base, near its sides, in addition to or lieu of the disclosed screw terminals for connection to line conductors.

What is claimed is:

1. A triplex electrical receptacle comprising:

a substantially rectangular body sized to fit in a NEMA-standard single wall box and having first and second opposite sides, first and second opposite ends, a face and a back;

phase, neutral and ground contacts within the body associated with respective first, second and third outlets and accessible via respective phase blade openings, neutral blade openings and ground prong openings in the face;

a neutral bus bar within the body connected to the neutral contacts of all three of the outlets; and at least one phase bus bar within the body connected to the phase contacts of at least two of the outlets, wherein the contacts of the first outlet are nearest a first corner of the body bounded by said first side and said first end, the contacts of the second outlet are nearest a second corner of the body bounded by said first side and said second end, and the contacts of the third outlet are between the contacts of the first and second outlets and closer to said second side than to said first side;

wherein said neutral bus bar has a central portion extending along said second side and supporting the neutral contact of the third outlet, and a neutral terminal thereon for connection to an external circuit, a first arm extending obliquely from said central portion toward said first corner and supporting the neutral contact of the first outlet, and a second arm extending transversely from said central portion near said second end toward said second corner and supporting the neutral contact of the second outlet;

wherein said phase bus bar has a phase terminal at said second side for connection to an external circuit, a first arm extending obliquely from said second side toward the first outlet and supporting the phase contact of the first outlet, and a second arm extending behind said first arm of said neutral bus bar longitudinally toward the third outlet and supporting the phase contact of the third outlet.

2. The triplex electrical receptacle of claim 1, wherein the phase and neutral blade openings of at least one of said first and second outlets are oblique to said sides and said ends of the body.

3. The triplex electrical receptacle of claim 1, wherein said phase bus bar has a third arm extending from the second arm thereof across the body toward the second outlet and supporting the phase contact of the second outlet.

4. The triplex electrical receptacle of claim 3, wherein said third arm is L-shaped, having a first leg extending transversely from said second side to said first side and a second leg extending from said first leg longitudinally toward the second outlet.

5. The triplex electrical receptacle of claim 4, wherein said second leg has a second phase terminal at said first side, and said first leg has two sections joined by a frangible connection that can be ruptured to electrically isolate said second phase terminal and the second outlet from said first phase terminal and the first and third outlets.

6. The triplex electrical receptacle of claim 5, wherein said frangible connection is accessible through a window in said back.

7. The triplex electrical receptacle of claim 6, wherein said frangible connection comprises a break-off tab.

8. The triplex electrical receptacle of claim 3, wherein said third arm is electrically connected to a second phase terminal at said first side and has a frangible section that can be ruptured to electrically isolate said second phase terminal and the second outlet from said first phase terminal and the first and third outlets.

9. The triplex electrical receptacle of claim 8, wherein said frangible connection is accessible through a window in said back.

10. The triplex electrical receptacle of claim 6, wherein said frangible connection comprises a break-off tab.

11. The triplex electrical receptacle of claim 1, wherein said at least one phase bus bar comprises a separate isolated phase bus bar connected only to the phase contact of the second outlet and having an isolated phase terminal at said first side for optional connection to the same or a different external circuit.

12. The triplex electrical receptacle of claim 11, wherein said isolated phase bus bar has an oblique arm extending toward and supporting the phase contact of the second outlet.

13. A triplex electrical receptacle comprising:

a substantially rectangular body sized to fit in a NEMA-standard single wall box and having first and second opposite sides, first and second opposite ends, a face and a back;

phase, neutral and ground contacts within the body associated with respective first, second and third outlets and accessible via respective phase blade openings, neutral blade openings and ground prong openings in the face;

a neutral bus bar within the body connected to the neutral contacts of all three of the outlets;

a first phase bus bar within the body having a first phase terminal at said second side for connection to an external circuit; and a second phase bus bar within the body having a second phase terminal at said first side for optional connection to the same or a different external circuit, wherein the contacts of the first outlet are nearest a first corner of the body bounded by said first side and said first end, the contacts of the second outlet are nearest a second corner of the body bounded by said first side and said second end, and the contacts of the third outlet are between the contacts of the first and second outlets and closer to said second side than to said first side;

wherein said neutral bus bar has a central portion extending along said second side and supporting the neutral contact of the third outlet, and a neutral terminal thereon for connection to an external circuit, a first arm extending from said central portion toward said first corner and supporting the neutral contact of the first outlet, and a second arm extending from said central portion toward said second corner and supporting the neutral contact of the second outlet;

wherein said first phase bus bar has a first arm extending from said second side toward the first outlet and supporting the phase contact of the first outlet, and a second arm extending behind said first arm of said neutral bus bar longitudinally toward the third outlet and supporting the phase contact of the third outlet; and wherein said second phase bus bar is connected to the phase contact of the second outlet.

14. The triplex electrical receptacle of claim 13, wherein said second phase bus bar has an oblique arm extending toward and supporting the phase contact of the second outlet.

15. The triplex electrical receptacle of claim 13, wherein each of said phase bus bars has a bridging arm with a distal end, the distal ends of said bridging arms defining a gap therebetween bridged by a frangible connection that electrically connects said phase bus bars but can be ruptured to electrically isolate them.

16. The triplex electrical receptacle of claim 15, wherein said frangible connection is accessible through a window in said back.

17. The triplex electrical receptacle of claim 16, wherein said frangible connection comprises a break-off tab.

18. A triplex electrical receptacle comprising:

a substantially rectangular body sized to fit in a NEMA-standard single wall box and having first and second opposite sides, first and second opposite ends, a face and a back;

phase, neutral and ground contacts within the body associated with respective first, second and third outlets and accessible via respective phase blade openings, neutral blade openings and ground prong openings in the face, wherein the contacts of the first outlet are nearest a first corner of the body bounded by said first side and said first end, the contacts of the second outlet are nearest a second corner of the body bounded by said first side and said second end, and the contacts of the third outlet are between the contacts of the first and second outlets and closer to said second side than to said first side;

a neutral bus bar within the body connected to the neutral contacts of all three of the outlets;

a first phase bus bar within the body connected to the phase contacts of the first and third outlets and having a first phase terminal at said second side for connection to an external circuit; and a second phase bus bar within the body connected to the phase contact of the second outlet and having a second phase terminal at said first side for optional connection to the same or a different external circuit, wherein each of said phase bus bars has a bridging arm with a distal end, the distal ends of said bridging arms defining a gap therebetween bridged by a frangible connection that electrically connects said phase bus bars but can be ruptured to electrically isolate them.

19. The triplex electrical receptacle of claim 18, wherein said frangible connection is accessible through a window in said back.

20. The triplex electrical receptacle of claim 19, wherein said frangible connection comprises a break-off tab.

* * * * *